US007641000B2

(12) United States Patent
Albert

(10) Patent No.: US 7,641,000 B2
(45) Date of Patent: Jan. 5, 2010

(54) SYSTEM FOR DIRECTIONAL BORING INCLUDING A DRILLING HEAD WITH OVERRUNNING CLUTCH AND METHOD OF BORING

(75) Inventor: Rene' Marcel Albert, Begijnendijk (BE)

(73) Assignee: Vermeer Manufacturing Company, Pella, IA (US)

( * ) Notice: Subject to any disclaimer, the term of this patent is extended or adjusted under 35 U.S.C. 154(b) by 468 days.

(21) Appl. No.: 11/134,239

(22) Filed: May 19, 2005

(65) Prior Publication Data

US 2005/0274548 A1 Dec. 15, 2005

Related U.S. Application Data

(60) Provisional application No. 60/573,706, filed on May 21, 2004.

(51) Int. Cl.
*E21B 7/06* (2006.01)

(52) U.S. Cl. ..... 175/61; 175/62; 175/74

(58) Field of Classification Search ..... 175/57, 175/92, 74, 101, 26, 320, 61, 62
See application file for complete search history.

(56) References Cited

U.S. PATENT DOCUMENTS

| | | | | |
|---|---|---|---|---|
| 4,236,619 | A | 12/1980 | Kuroda | |
| 4,546,864 | A | 10/1985 | Hagen et al. | |
| 4,699,224 | A * | 10/1987 | Burton | 175/61 |
| 4,732,223 | A * | 3/1988 | Schoeffler et al. | 175/73 |
| 5,125,463 | A | 6/1992 | Livingstone et al. | |
| 5,155,442 | A | 10/1992 | Mercer | |
| 5,775,444 | A * | 7/1998 | Falgout, Sr. | 175/322 |
| 5,880,680 | A | 3/1999 | Wisehart et al. | |
| 5,941,322 | A | 8/1999 | Stephenson et al. | |
| RE36,556 | E * | 2/2000 | Smith et al. | 175/45 |
| 6,082,470 | A * | 7/2000 | Webb et al. | 175/45 |
| 6,092,610 | A * | 7/2000 | Kosmala et al. | 175/61 |
| 6,138,780 | A | 10/2000 | Beuershausen | |
| 6,308,787 | B1 | 10/2001 | Alft | |
| 6,325,163 | B2 | 12/2001 | Tibbitts | |
| 6,390,087 | B1 | 5/2002 | Wentworth et al. | |
| 6,390,207 | B2 | 5/2002 | Wentworth et al. | |
| 6,394,193 | B1 * | 5/2002 | Askew | 175/61 |
| 6,454,025 | B1 | 9/2002 | Runquist et al. | |
| 6,588,516 | B2 * | 7/2003 | Runquist et al. | 175/61 |
| 6,595,303 | B2 * | 7/2003 | Noe et al. | 175/74 |
| 6,708,782 | B1 | 3/2004 | Turney | |
| RE38,498 | E | 4/2004 | Ruth et al. | |

(Continued)

FOREIGN PATENT DOCUMENTS

| | | |
|---|---|---|
| WO | WO 00/55468 | 9/2000 |
| WO | WO 2005/003505 A1 | 1/2005 |

*Primary Examiner*—William P Neuder
*Assistant Examiner*—David Andrews
(74) *Attorney, Agent, or Firm*—Merchant & Gould P.C.

(57) ABSTRACT

A drilling system including a drill head configured to couple to a drill string. The drill head including an offset adapter, a one-way clutch, and a drill bit. The drill head being configured to provide straight drilling along a first axis, and deviated drilling along a second axis. The drilling system further including a gearbox configured to provide selective rotational operation corresponding to the straight drilling and the deviated drilling. The drilling system also including control systems to control the selected rotational operation of the gearbox.

20 Claims, 18 Drawing Sheets

U.S. PATENT DOCUMENTS 6,892,830 B2 * 5/2005 Noe et al. ..... 175/61
2003/0131992 A1 7/2003 Michael et al.
2004/0238219 A1 * 12/2004 Nichols et al. ..... 175/57
2005/0211473 A1 * 9/2005 Zupanick ..... 175/75

* cited by examiner

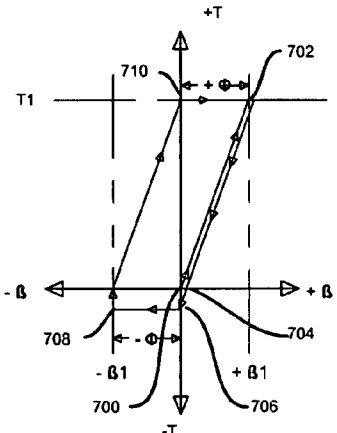
Fig 17a
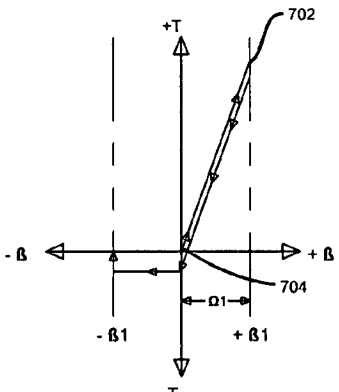
Fig 17b
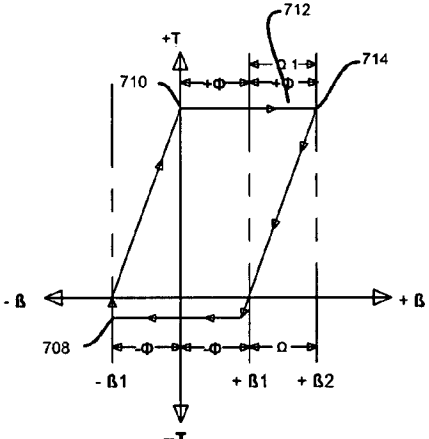
Fig 17c
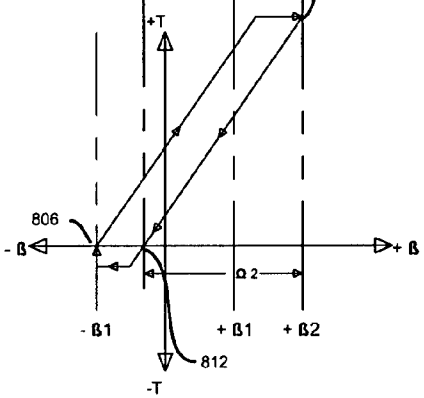
Fig 18a
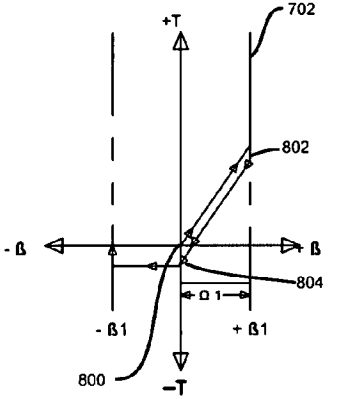
Fig 18b
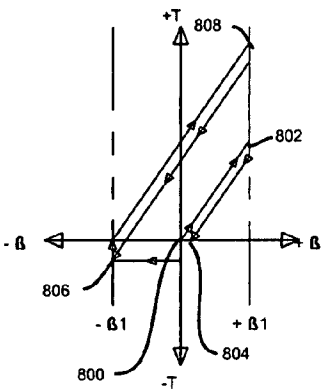
Fig 18c
Fig 18d

SYSTEM FOR DIRECTIONAL BORING INCLUDING A DRILLING HEAD WITH OVERRUNNING CLUTCH AND METHOD OF BORING

CROSS-REFERENCE TO RELATED APPLICATIONS

This application claims the benefit of U.S. Provision Application No. 60/573,706, filed on May 21, 2004; which application is incorporated herein by reference.

TECHNICAL FIELD

This invention generally relates to a boring system for horizontal drilling; and more specifically to a device and method of boring through a variety of soil types ranging from compressible soils to hard rock.

BACKGROUND

Horizontal drilling systems currently in use include technology known as mud motor technology, pipe-in-pipe technology, rotary steerable devices, and hammer technology. Each system has inherent limitations related to the system's operation and method of use.

Mud motor technology utilizes drilling fluid to transfer power from a drill rig located at a ground surface, through a drill string comprised of inter-connected drill rods, to a down-hole motor. The drill string is connected to the rear end of the mud motor is connected; while a drill bit, attached to an output shaft, is connected to a front end of the mud motor. The drill bit is powered rotationally by torque generated by drilling fluid passing through the motor. The drill bit can thus be rotated, while the drill string is held from rotating. Directional control is achieved by the addition of an offset coupling that offsets the center-line of the drill bit from the center-line of the drill string and mud motor. In particular, to control the direction of the drill bit, the drill string is held from rotating, and the drill bit rotated by the mud motor. The drill sting then moves the assembly longitudinally forward, creating a bored hole in the direction of the centerline of the drill bit. To bore a straight hole, the drill string, mud motor and offset coupling are all rotated to create a bored hole in the direction of the centerline of the drill string.

One limitation of mud motors is related to the capacity to transmit power to the drill bit. Since the drill string is not rotationally secured to the drill bit, the mud motor must provide the rotational power to the bit. The length of the motor is typically a function of the rotational power provided to the bit. In some applications, the length required to develop sufficient torque is significant. Further, the construction of mud motors is such that they are typically less flexible than the drill rod. This combination of length and stiffness can limit the directional control capability of mud motor systems.

A second inherent limitation of mud motors is related to the use of the drilling fluid to provide rotational power to the drill bit. Since mud flow rate and pressure determine the power transferred to the drill bit, the rate and pressure must be maintained in order to maintain drilling speed. In some situations, other aspects of drilling are affected by the flow rate of the drilling mud, and it may be desirable to reduce either the flow rate or the pressure. These situations compromise the efficiencies of the contrasting aspects of a drilling operation. For instance, a "frac-out" can occur as a result of excessive flow or excessive pressure of the drilling fluid. A frac-out situation is where drilling fluid is forced though a fracture in the ground rather than through the bored hole. In a frac-out situation, it is desirable to reduce flow rate or fluid pressure to cease further expansion of the ground fracture. Preferably, the flow rate and pressure are at an initially reduced level to prevent the probability of a frac-out altogether. However, reducing the flow rate and pressure negatively affects drilling performance.

A third inherent limitation is related to the need for the drill bit to be offset from the centerline of the mud motor. This offset requires a complicated drive shaft assembly in order to transfer the rotary power through the offset. The drill bit is mounted to the drive shaft, which is inherently more flexible than the motor housing. The resulting assembly has several limitations including significant initial cost associated with the complicated assembly, limited durability, and a flexibility that can affect the dynamic stability of the drill bit during drilling.

Pipe-in-pipe technology operates in a similar fashion. The drill bit is oriented at an end of an outer drill string with a center that is offset with respect to the center of the outer drill string. An inner pipe rotationally powers the drill bit independent from rotation of the outer drill string. To achieve directional control of the drill bit, the outer drill string is held from rotating while the inner drill pipe rotates the drill bit. The drill string is then moved forward to create a bored hole in the direction of the offset. To bore a straight hole, the outer drill string, the inner drip pipe and the drill bit are all rotated to create a bored hole in the direction of the centerline of the outer drill string.

One limitation of this technology relates to the size of the component that provides rotational power to the drill bit, i.e., the inner pipe. Because the diameter of the inner pipe is smaller that the outer drill string, the maximum torque that can be transferred to the drill bit is less than the maximum torque that could be transferred by the outer drill string.

A second limitation of pipe-in-pipe technology is related to the inherent flow restriction of the pipe-in-pipe configuration. Drilling fluid is required to cool the drill bit and to transfer the cuttings out of the bored hole. The rate of drilling can be limited by the fluid flow rate. The cross-sectional area of the inner drill pipe, which is used to transfer the fluid, is less than the cross-sectional area of the outer drill string. Thus, the maximum flow rate is lower, or the fluid pressure at the drill rig is higher for a given flow rate, with a pipe-in-pipe system as compared to other systems utilizing the outer drill string for fluid transfer.

Rotary steerable devices include a down-hole housing mounted on the drill string on bearings such that the housing can remain stationary while the drill string rotates. A drill bit is powered rotationally by an extension of the drill string and a drive shaft that extends through the down-hole housing. The down-hole housing has some form of offset to subject the drill bit to an unbalanced load condition, causing it to change the direction of the borehole. The orientation of the down-hole housing determines the boring direction of drill bit.

A limitation of rotary steerable devices is related to the fact that there is a non-fixed relationship between the down-hole housing and the drill string. Many designs have been developed to control of the position of the housing relative to the drill string. Typically the designs involve manipulating the drill string. Any change in orientation of the down-hole housing in relation to the drill string during general operation will affect the direction of the bored hole. Changes in orientation of the housing relative to the drill string are unpredictable making operation complicated and the results unreliable.

Hammer technology utilizes drilling fluid to transfer power from the drill rig at the surface, through a drill string comprised of inter-connected drill rods, to a down-hole hammer. The drill string is connected to a rear end of the hammer. A drill bit, attached to an output shaft of the hammer, is connected at a front-end of the hammer. The drill bit is powered longitudinally with impact impulses from the hammer. The drill bit is able to cut through hard materials such as rock, without requiring full rotation of the drill bit. To achieve directional control, the drill string is oscillated rather than rotated. For example, the drill string can be oscillated slightly while the drill bit is cutting with the impact impulses generated by the fluid activated hammer to control the direction of boring. Specifically, the drill bit is oriented in manner such that an effective center of the bit is offset from the center of the drill string while the drill string is moved forward. To bore a straight hole, the drill string, the hammer, and the drill bit are all rotated to create a bored hole in the direction of the centerline of the drill string.

A limitation of the hammer technology is related to the capability of the drilling fluid, used with currently available hammers, to carry cuttings. Commercially available hammers useful for this type of horizontal boring are activated with compressed air. The capability of compressed air to carry and transport sizable cuttings is less than the capability of drill mud used with either mud motors or pipe-in-pipe technology. Further, the maximum length of a bored hole is limited by the capability of the fluid to transfer the cuttings a particular distance.

Thus, a need exists for a versatile drilling tool that reduces the effect of the above noted limitations.

SUMMARY

In accordance with one aspect of the present invention the drill string includes both an offset coupling and a novel boring head such that torque is transferred through the drill string and through the offset coupling to a rotary drill bit.

In accordance with another aspect of the present operation a directional bore can be made in both compressible soils and hard rock.

In accordance with another aspect of the present invention the rotational torque and longitudinal forces acting on the drill bit are transferred exclusively mechanically, through the drill rod, independent of the drilling fluid. This aspect allows the flow rate and pressure of the drilling fluid to be controlled to optimize its capacity to cool the drill bit and carry the cuttings, while minimizing the potential negative effects of excessive drilling fluid flow rate or pressure. The fluid can further be tailored and utilized to aid the cutting for certain soil types.

In accordance with another aspect of the present invention a symmetrical drill bit can be utilized, with the novel boring head, to bore either in alignment with, as an extension of the drill string, or deviated from that direction, while using the drill bit in a consistent manner. In both cases the drill bit is rotated in only one direction, the bit is never rotated in reverse. Since the method of operating the drill bit, uni-directional rotation, is consistent, the resulting bore hole will also be a consistent cross-section.

In accordance with another aspect of the present invention the method utilized for boring in a desired direction, a direction that deviates from the extension of the drill string, includes rotation of the drill string. This rotation results in minimizing frictional drag forces acting on the drill string.

In accordance with another aspect of the invention, a variety of bits can be utilized, allowing an optimized bit to be used, one matching the requirements of the particular soil type being bored.

In accordance with another aspect of the invention, the requirements of the drill rig are not changed from those of a standard drill rig, allowing the present invention to be utilized with standard drill rigs.

BRIEF DESCRIPTION OF THE DRAWINGS

FIG. 9(*a*)-(*c*) are schematics of the gearbox showing the range of oscillation;

FIG. 11(*a*) is a cross-section of the gearbox taken along line 11-11 of FIG. 9, with the interlock bar in the position corresponding positions other than that illustrated in FIG. 9;

FIGS. 17(*a*), (*b*) and (*c*) are graphs illustrating various oscillation patterns with a first drill string flexibility; and FIGS. 18(*a*), (*b*), (*c*) and (*d*) are graphs illustrating various oscillation patterns with a second drill string flexibility.

DETAILED DESCRIPTION

Figure 1:
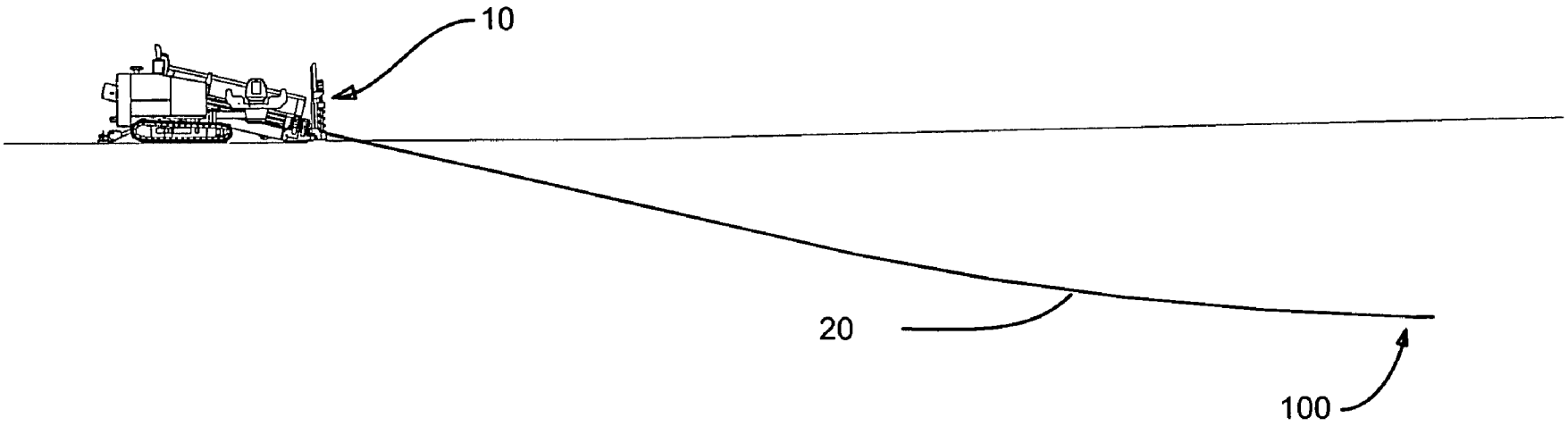
FIG. 1 is a side view showing the typical horizontal directional drilling environment in which the present invention is used.

The features of the present invention which are believed to be novel are set forth with particularity in the appended claims. The invention, together with the further objects and advantages thereof, may best be understood by reference to the following description taken in conjunction with the accompanying drawings, in which like reference numerals identify like elements.

Referring to the drawings, and in particular to FIG. 1, a drilling machine or rig 10 is positioned at the surface, connected to and driving a drill string 20 that extends to a boring head 100. The drilling rig typically is capable of rotating the drill string and also capable of forcing the drill string longitudinally away from the drilling rig, extending the length of the bore, which will be referred to herein as thrust. The drilling rig is likewise capable of pulling the drill string back towards the drilling rig, shortening the drill string, which will be referred to herein as pullback.

The drilling rig 10 is normally used to form a pilot bore from an entry point, extending through the ground, along a planned route, to avoid underground obstacles and terminating at an exit point. During operation, the drilling rig 10 rotates and pushes the drill string 20 and boring head 100 into contact with the ground. The operation includes two basic types of steering or drilling modes: straight and deviated. In the straight mode, the bored hole is extended in a direction parallel and coaxial with a longitudinal axis of the drill string 20. In the deviated mode, the bored hole is extended in a direction that is angled from the longitudinal axis of the drill string 20. For example, the direction of the bored hole may be angled or deviated relative to the longitudinal axis of the drill string in an upward direction (known as a 12:00 direction), a downward direction (known as a 6:00 direction), a leftward direction (known as a 9:00 direction), or a rightward direction (known as a 3:00 direction). Using both modes of drilling, combined with electronic detection systems located at the boring head, operators can selectively direct a boring operation.

When a pilot bore has been completed by a boring operation, a product, such as a water line or an electrical cable, is attached to the drill string and pulled back through the bored hole. During the pull back operation, the size of bored hole is enlarged, as necessary to provide adequate clearance for utility components.

In a typical installation, the initial ground conditions include generally compressible soils. As the bore progresses, it is not unusual for the ground conditions to change to include more difficult conditions, including rock or hard compacted soils. The boring head 100 of the present disclosure provides advantages in having an ability to bore through the variety of soil conditions.

Figure 2:
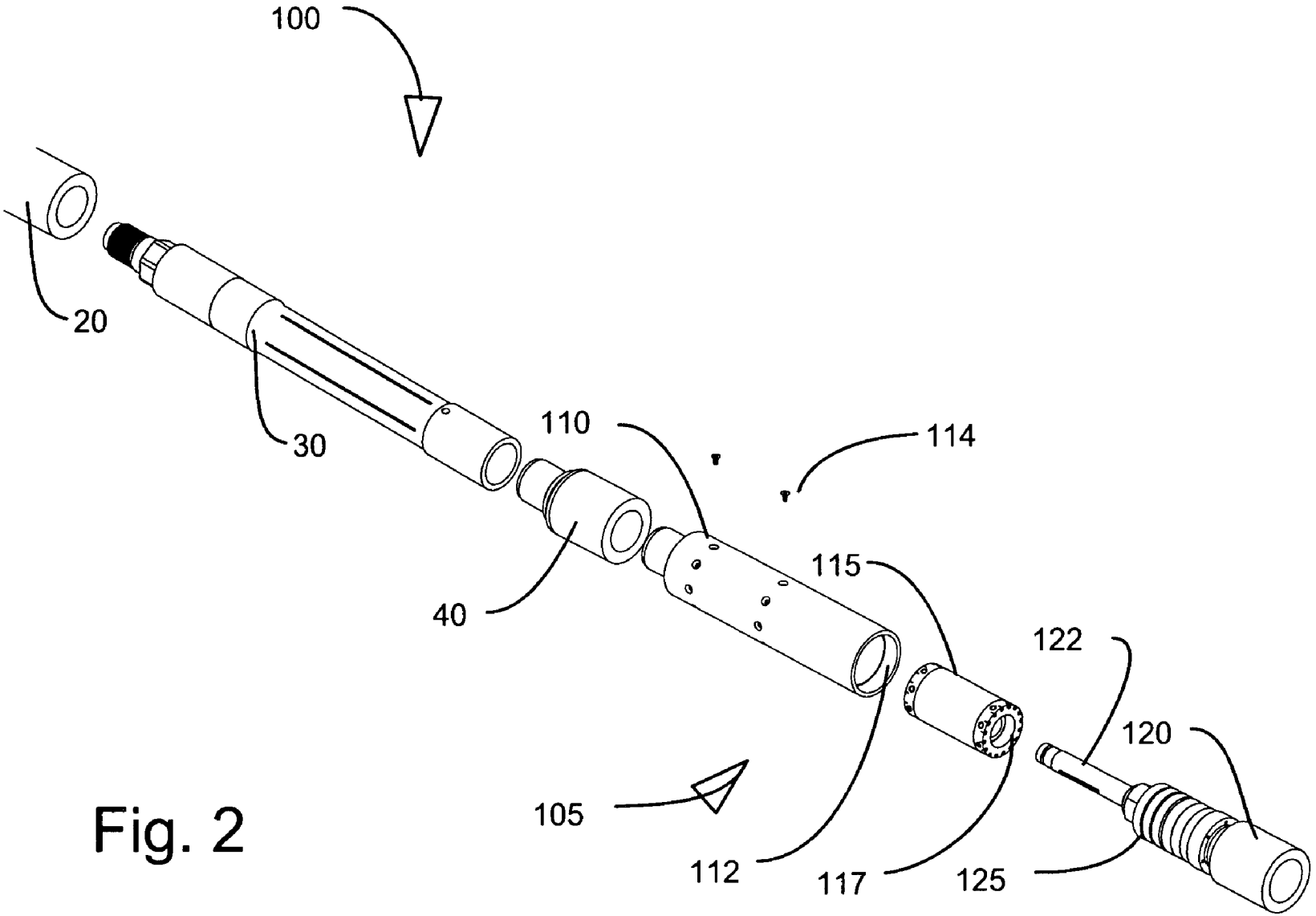
FIG. 2 is an isometric view illustrating the components of the boring head of the present invention.

A first embodiment of the boring head 100 is illustrated in FIG. 2. The boring head 100 includes a sonde housing 30, an offset coupling or adaptor 40, and a bit drive element 105. The bit drive element 105 includes an outer drive housing 110, a one-way clutch 115, a bit drive adaptor 120 and thrust bearings 125. The one-way clutch 115 is a well-known mechanical device that includes components that permit transfer of rotational torque in one rotary direction while allowing free rotation in the opposite direction. Exemplary one-way clutches are disclosed in U.S. Pat. No. 4,236,619 to Kuroda, U.S. Pat. No. 4,546,864 to Hagen et. al, and U.S. Pat. RE38, 498 to Ruth, et. al. A preferred commercially available unit is currently produced by Ringspann, and is marketed as a Freewheel Element. The example one-way clutch 115 illustrated is configured to slide into an inner bore 112 of outer drive housing 110, and to be secured with retainers 114. The one-way clutch 115 has an inner bore 117 configured to accept a drive shaft 122 of the bit drive adaptor 120. The inner bore 112 of the outer drive housing 110 is further configured to accept the thrust bearings 125 in a manner such that thrust loads from the drill string 20 are transferred to the bit drive adaptor 120 separate from or independent of rotational loads.

Figure 3:
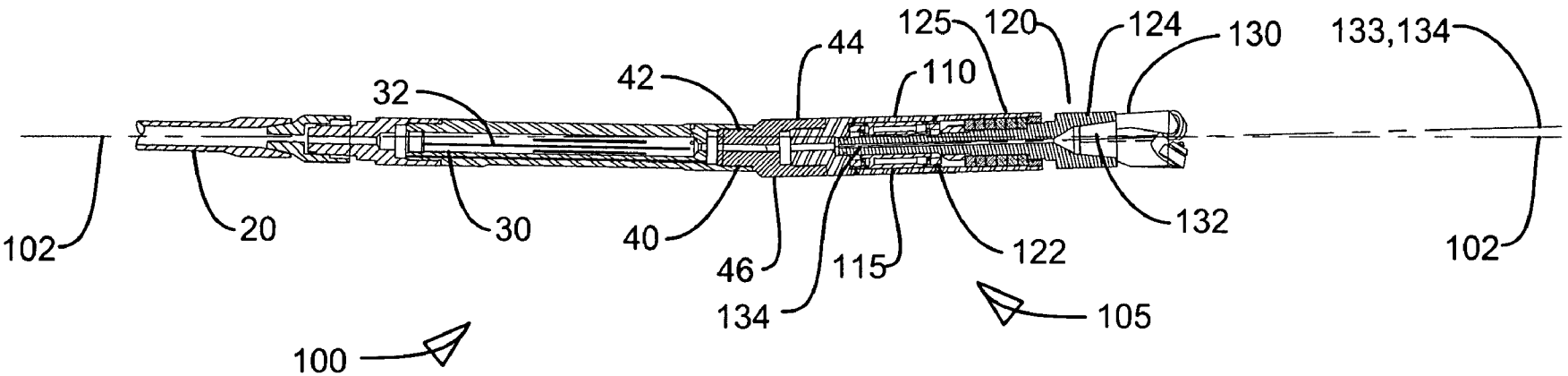
FIG. 3 is side view in cross section of a configuration of elements making up a first embodiment of a boring head of the present invention, with a tri-cone bit.

FIG. 3 illustrates the boring head 100 with all components assembled, and including a tri-cone roller bit 130 connected to the bit drive element 105. The bit drive element 105 is attached to the offset adaptor 40. The offset adaptor 40 includes a first end 42 and a second opposite end 44. The first end 42 of the offset adaptor is attached to the sonde housing 30 and adjacent to the drill string 20. The second end 44 of the offset adaptor is attached to the bit drive element 105.

The first end 42 of the offset adaptor 40 defines a first axis 102 that is offset from a second axis 133 of the second end 44 of the offset adaptor 40. The embodiment illustrated in FIG. 3 shows the first axis 102 angled from the second axis 133. The amount of offset can be fixed or adjustable. An adaptor having an adjustable configuration is disclosed in U.S. Pat. No. 5,125,463 to Livingstone et al., incorporated herein by reference, wherein the angle is adjustable by rotating a first end relative to a second end of the adaptor prior to locking the two ends together.

The tri-cone roller bit 130 is a well-known drilling tool and generally includes a bit pin 132. The bit pin 132 is configured to engage a box 124 of the bit drive adaptor 120. The tri-cone roller bit 130 defines an axis of rotation 134 that is coaxial with the second axis 133 of the second end 44 of the offset adaptor 40. Typically, the tri-cone roller bit 130 is structurally symmetrical about the axis of rotation 134, and includes a cutting face oriented perpendicular to and symmetrical about the axis of rotation 134. When rotated and longitudinally forced forward, the tri-cone roller bit 130 will form a bored hole concentric to the axis of rotation 134. Typically, roller cone bits are configured to be rotated in one direction, and configured to provide consistent full face cutting when rotated consistently in this one direction. Partial rotation or incomplete rotation can result in reduced consistency or unacceptable performance.

The boring head 100 of the present disclosure is configured to be operated in two different modes: a first mode involving continuous full rotation of the drill string 20 for straight drilling; and a second mode involving interrupted rotation of the drill string 20 for deviated drilling.

While in the first or straight drilling mode, the drill head 100, including the bit 130, is continuously rotated by the drill string 20, about the first axis 102. In this mode, the second axis 133, and the cutting face of the bit 130, rotate about the first axis 102. Accordingly, the bit 130 rotates about the axis of rotation 134 while also revolving about the first axis 102. The direction of advancement of the bored hole is generally parallel to the first axis 102 (i.e. the longitudinal axis of the drill string 20). As the drill string 20 rotates, an offset side 46 (FIG. 3), that is, the axially offset second end 44 of the offset adaptor 40 rotates through a full rotation defining a maximum radius of the bored hole. The offset side 46 typically includes kick pads or wear pads (not shown) constructed of wear resistant material, and constructed in a manner to permit replacement or modification. In applications using an adjustable offset adaptor 40, the angular offset can be selected such that the offset side 46 will contact the full circular outer diameter of the bored hole, and the maximum radius will be equal to or more than the diameter of the bored hole.

While in the second or deviated drilling mode, the drill string 20 is oscillated through a steering arc. To create the steering arc, the drill string 20 is oscillated through a steering arc sequence. The steering arc sequence includes, for example, rotating the drill string 20 in a first direction for a partial rotation (for instance, a partial rotation of +45 degrees), then rotating the drill string 20 in a second reversed direction for a partial rotation (for instance, a partial rotation of −90 degrees). At this point the drill string is in a position of −45 degrees. From this position, the steering arc sequence is repeated. As the drill string 20 continues to oscillate through this steering arc sequence, the one-way clutch 110 functions to allow the bit drive adaptor 120 and drill bit 130 to be rotated in a single direction, i.e., in the first direction, in an interrupted manner. In particular, the one-way clutch 115 allows the drill bit 130 to remain stationary when the drill string 20 is rotated in the reverse direction, while permitting rotation of the drill bit 130 with the drill string 20 in the first forward direction. Thus, when the drill string 20 is oscillated rotationally back and forth within the steering arc, the bit 130 and bit face will rotate uni-directionally about axis of rotation 134, while the offset side 46 of offset adaptor 40 remains in the steering arc. As the drill string is moved longitudinally forward during this rotational oscillation, the offset side 46 of the offset adaptor 40, and the corresponding side of the bit drive element 105 will contact the outer diameter of the bored hole, creating a steering force. Accordingly, the bored hole will advance approximately parallel to the second axis 133, and angled or deviated from the first axis 102.

The size of the steering arc may affect how aggressively the system is able to steer. A smaller arc will tend to have more aggressive steering. The size of the steering arc will also affect the speed at which the drill bit can be rotated. With a steering arc of 90 degrees, the drill string will oscillate four times for each rotation of the drill bit. With a steering arc of 180 degrees, the drill string will oscillate two times for each rotation of the drill bit. The steering arc will preferably range between 45 degrees to 270 degrees relative to the longitudinal axis of the drill string; more preferably, the steering arch is between 60 degrees to 180 degrees so that the speed of rotation of the drill bit and the steering characteristics are more acceptable.

The direction of the boring process is controlled by positioning the offset side 46 of the offset adaptor 40 to the side opposite the desired angular direction. For instance, if the desired boring direction is upward, or in a 12:00 direction, the offset side 46 will be positioned downward, or at a 6:00 position. The position is measured by a sonde 32 (schematically represented by a line in FIG. 3) positioned within the sonde housing 30. Exemplary illustrations of a sonde are disclosed in U.S. Pat. No. 5,155,442 and U.S. Pat. No. 5,880,680, both incorporated herein by reference. The rotational position of the sonde 32 is typically calibrated with the orientation of the offset side 46 of the offset adaptor 40. This can be accomplished in any manner. One such calibration option, disclosed in co-assigned U.S. application 20030131992, and incorporated herein by reference, includes the steps of assembling the components prior to final installation of the sonde, and orienting the sonde in relation to offset side 46 such that the sonde will read the clock position directly opposite the clock position of the offset side 46. In this method, the clock position is an indication of the direction that the boring will progress. Many other options could be performed to aid the accuracy of this step, including the process disclosed in U.S. Pat. No. 6,708,782, which is also incorporated herein by reference.

In both modes of drilling, a longitudinal force from the drill string 20 is applied to the drill bit 130 to cause the bored hole to advance. In the straight drilling mode, the longitudinal force may be held constant. An advantage of the present invention, provided by the function of the one-way clutch, is that this longitudinal force can be applied in the same manner during deviated drilling. However, during deviated drilling, the longitudinal force during rotation in the second reverse direction is not required. Longitudinal forces are generally only required during rotation in the first direction for advancing the bored hole. It may be advantageous in some conditions to reduce or eliminate longitudinal forces during reverse rotation. For example eliminating longitudinal forces during reverse rotation reduces the wear rate on the offset side 46 of the offset coupling 40. Either method of eliminating/reducing longitudinal forces or holding longitudinal forces constant can be used in conjunction with the present invention.

Figure 4:
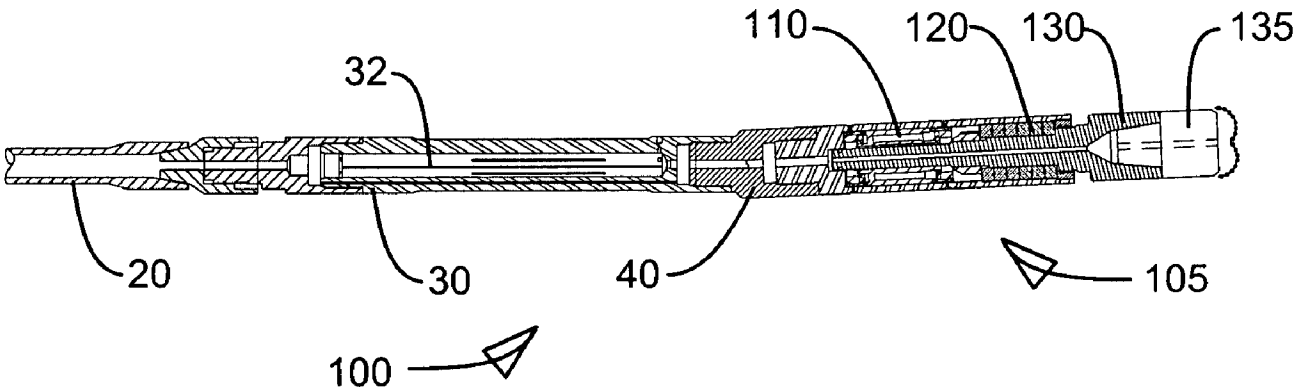
FIG. 4 is side view in cross section of a configuration of elements making up a first embodiment of a boring head of the present invention, with a drag-cutter bit.

Referring now to FIG. 4, the boring head 100 of the present disclosure is illustrated with drag cutting bit 135. One example of a drag cutting bit 135 is disclosed in U.S. Pat. No. 6,138,780 to Beuerhausen, which is herein incorporated by reference. This style of bit cuts in a symmetrical manner similar to that of the roller cone bit 130. The cutting action of the drag bit 135 however is much different than the roller cone bit, and often times requires more torque and longitudinal force. To address the torque characteristics of the drag bit 135, the drilling head of the present disclosure may include means to limit torque fluctuations resulting from use of the drag bit. One example of a means to limit torque fluctuations is disclosed in U.S. Pat. No. 6,325,163 to Tibbitts, which is herein incorporated by reference.

In certain conditions, the drag bits 135 offer advantages, while in other conditions, the roller cone bits 130 offer advantages. With either type of bit, there are benefits to the ability to operate with symmetrical bits. Thus, the drill head 100 of the present disclosure is illustrated with symmetrical bits. It is contemplated, nonetheless, that the drill head 100 can be used with any type of drill bit, including non-symmetrical bits.

Figure 4A:
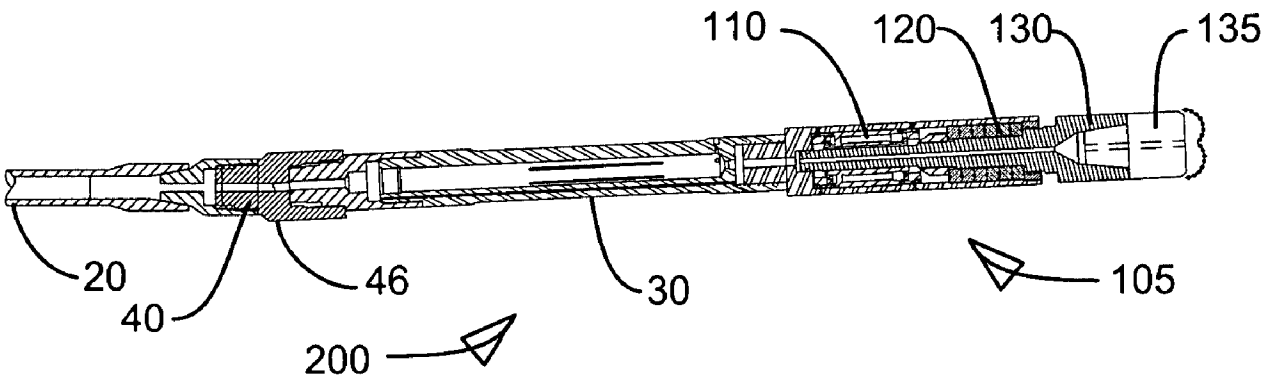
FIG. 4*a* is a side view in cross section of a second configuration of elements making up a second embodiment of a boring head of the present invention.

FIG. 4*a* illustrates a second embodiment of a boring head 200 of the present disclosure, wherein the position of the sonde housing 30 and the offset adaptor 40 are reversed. This configuration provides different boring dynamics resulting from the increased distance between the offset adaptor 40 and the drill bit 130; and positions the sonde 32 closer to the drill bit 130, which may have advantages in some situations. This configuration may be advantageous with either the drag cutting bit 135 as shown, or a roller cone bit 130 (FIG. 3).

Figure 5:
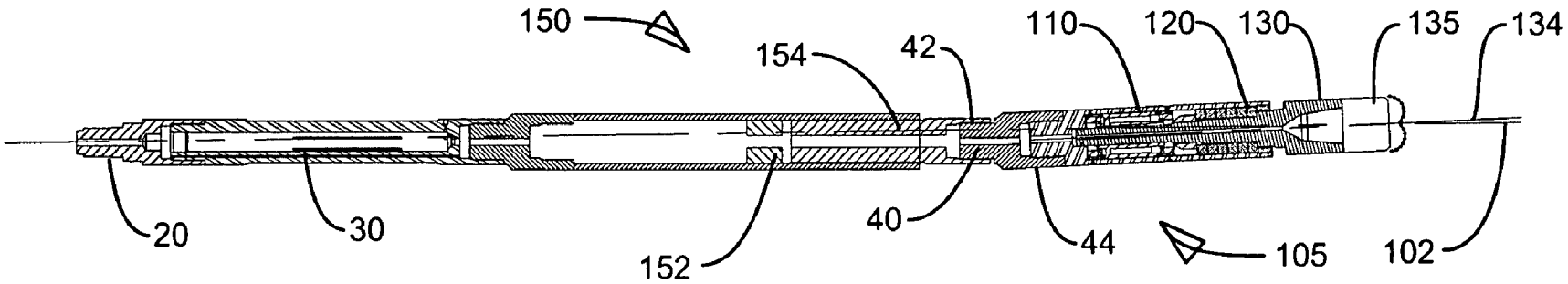
FIG. 5 is a schematic side view, in cross section, of a configuration of elements making up a third embodiment of a boring head of the present invention.

FIG. 5 illustrates a third embodiment of a boring head 300 incorporating the principles of the present disclosure, and wherein a hammer 150 has been incorporated. Hammers are well known—one example being disclosed in U.S. Pat. No. 6,390,207, which is incorporated herein by reference. The illustrated hammer 150 includes a sliding component 152 that oscillates back and forth by fluid as the fluid is forced through the hammer. The sliding component oscillates to impact against a holder 154. The resulting impact force assists the boring action. In the arrangement illustrated, the hammer 150 is located adjacent to the first end 42 of the offset adapter 40. Accordingly, the resulting impact force is parallel to the first axis 102, and to the longitudinal axis of the drill string 20.

Figure 5A:
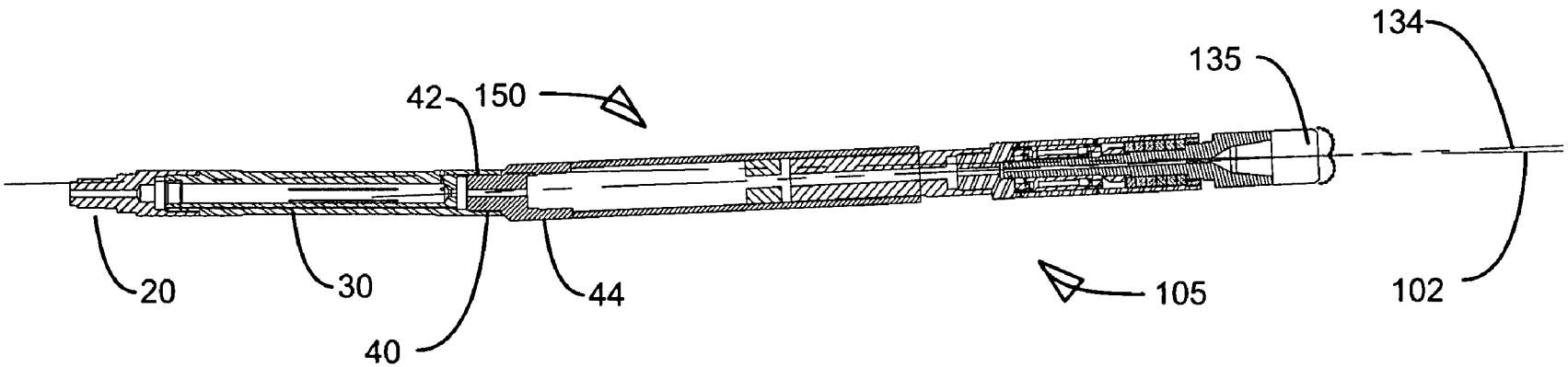
FIG. 5*a* is a schematic side view, in cross section, of a configuration of elements making up a fourth embodiment of a boring head of the present invention.

FIG. 5*a* illustrates a fourth embodiment of a boring head 400 configured with a hammer 150 positioned adjacent to the second end 44 of the offset adapter 40. In this arrangement, the resulting impact force is parallel to the second axis 133, and to the axis of rotation 134 of the drill bit 135 (or 130).

Figures 6A, 6B, 6C, 6D, 6E:
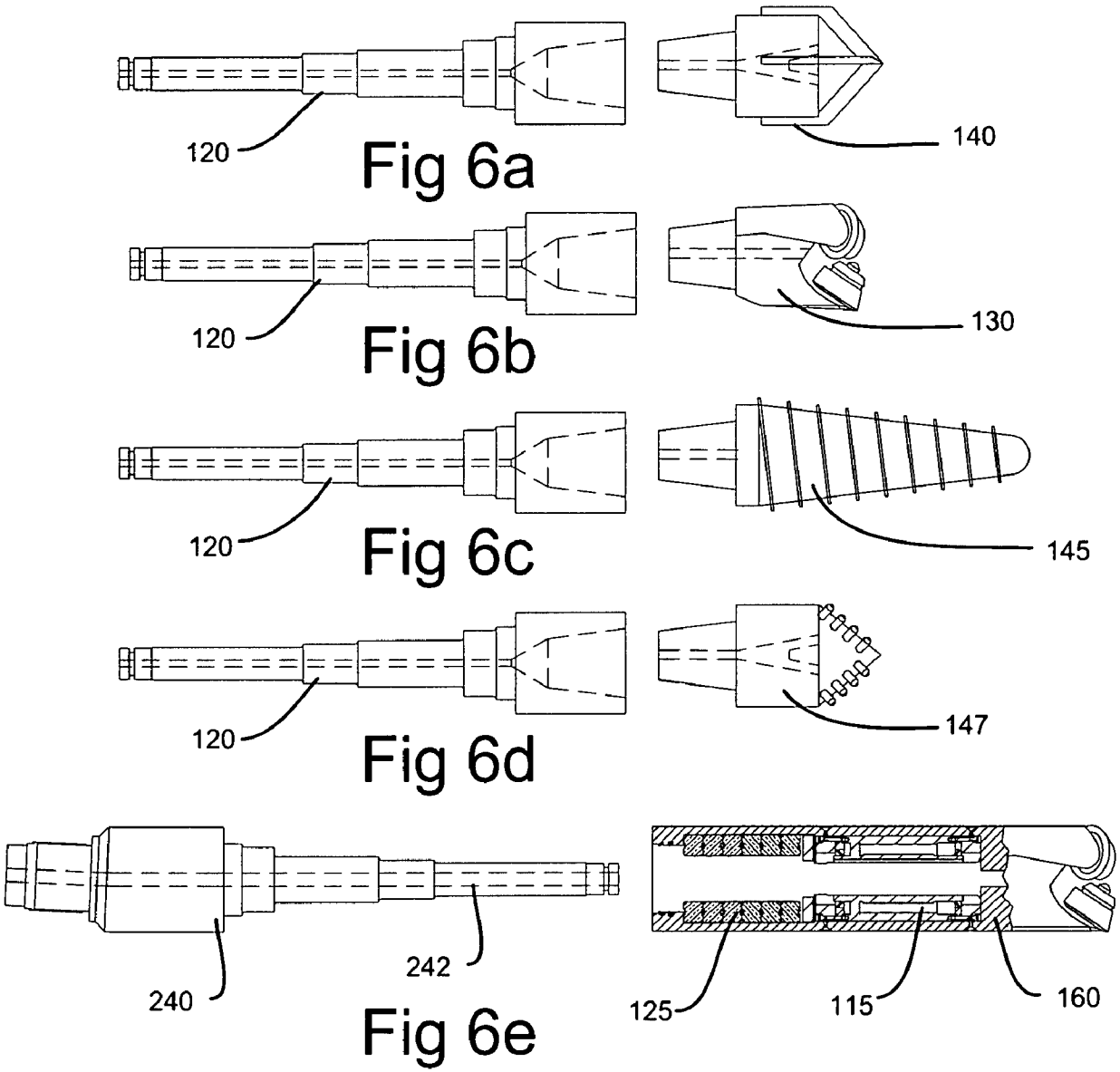
FIG. 6(*a*) through 6(*e*) are schematic side views illustrating possible drill bit configurations that can be implemented with the boring head of the present invention.

FIG. 6*a* through 6*e* illustrate various configurations of drill bits that are useful with the presently disclosed boring head embodiments 100-400. FIG. 6*a* illustrates a second embodiment of a drag cutting bit 140 configured to adapt to the bit drive adaptor 120. FIG. 6*b* illustrates the roller cone bit 130, as previously described, configured to adapt to the bit drive adaptor 120. FIG. 6*c* illustrates a spiral bit 145 configured to adapt to the bit drive adaptor 120. FIG. 6*d* illustrates a yet another embodiment of a drag cutting bit 147 configured to adapt to the bit drive adaptor 120.

FIG. 6*e* illustrates a configuration of the present disclosure where still another bit 160 is configured to include the one-way clutch 115 and bearings 125. This configuration would require a different offset adaptor 240, including a drive shaft 242, and could incorporate any of the previously described bits (e.g. roller cone bit, spiral bit, drag-cutting bit).

Figure 7:
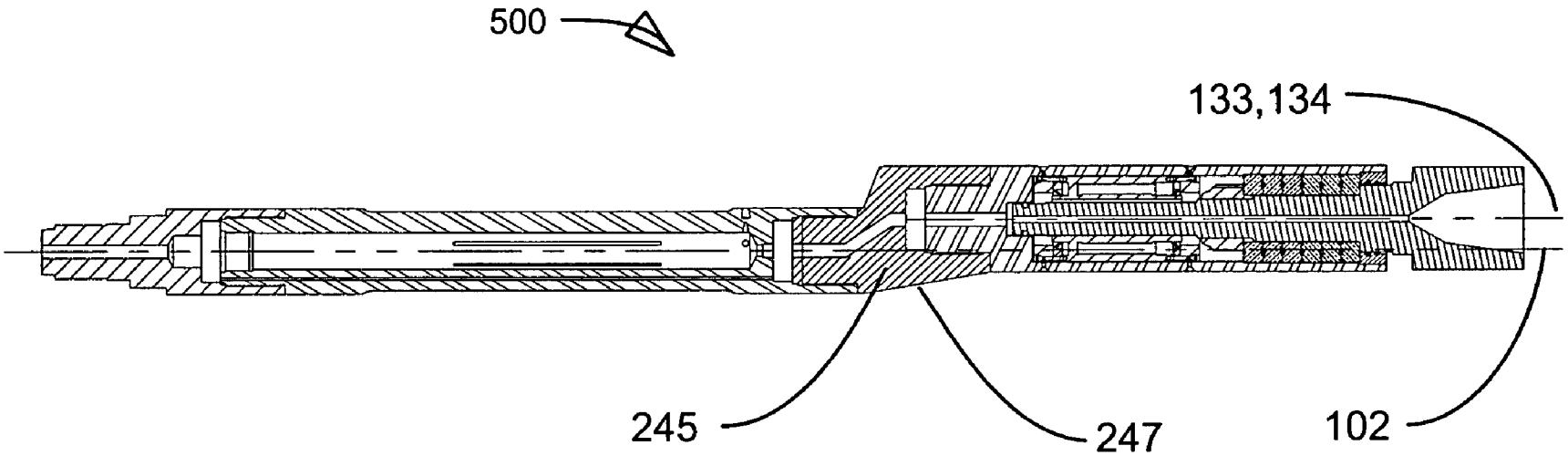
FIG. 7 is a schematic side view, in cross section, of a configuration of elements making up a fifth embodiment of a boring head of the present invention.

FIG. 7 illustrates a fifth embodiment of a boring head 500 of the present disclosure wherein the offset adaptor 245 is constructed to offset the second axis 133 and the axis of rotation 134 of the drill bit from the first axis 102, while keeping the axes parallel. The offset adapter 245 includes a reaction surface 247 that causes the direction of the bored hole to deviate. The reaction surface 247 may include kick pads or wear pads (not shown). All other aspects of the boring head 500 are similar to the features previously described.

One aspect of the present disclosure is the simplicity of varying operation between the two drilling modes, i.e., the straight drilling mode and the deviated drilling mode. In particular, the only required difference between the two modes is the method of rotating the drill string 20. In straight drilling mode, the drill string 20 is rotated continuously; while for the deviated drilling mode, the drill string 20 is oscillated. In both modes, the drill string is thrust forward to maintain an appropriate longitudinal force on the drill bit, sometimes referred to as the weight of bit (WOB).

Referring back to FIG. 1, the drilling rig 10 typically includes a diesel motor that powers a hydraulic pump, and an operator station with controls that allow the operator to control the hydraulic system, the flow rate and flow direction of oil transferred to rotation motors. The rotation motors cause the drill string 20 to rotate and force the drill string to extend, during boring, or retract, during backreaming.

The longitudinal movement of the drill string 20 is typically accomplished by attaching the drill string 20 to a gearbox. The gearbox is supported for linear movement along a rack. The linear movement is typically provided by a hydraulic cylinder or by a hydraulic motor, pinion gear and rack gear. These mechanisms are not illustrated as they are well known and any configuration can be used. The rotation of the gearbox is typically provided by a hydraulic motor that is mounted to the gearbox.

Figure 8:
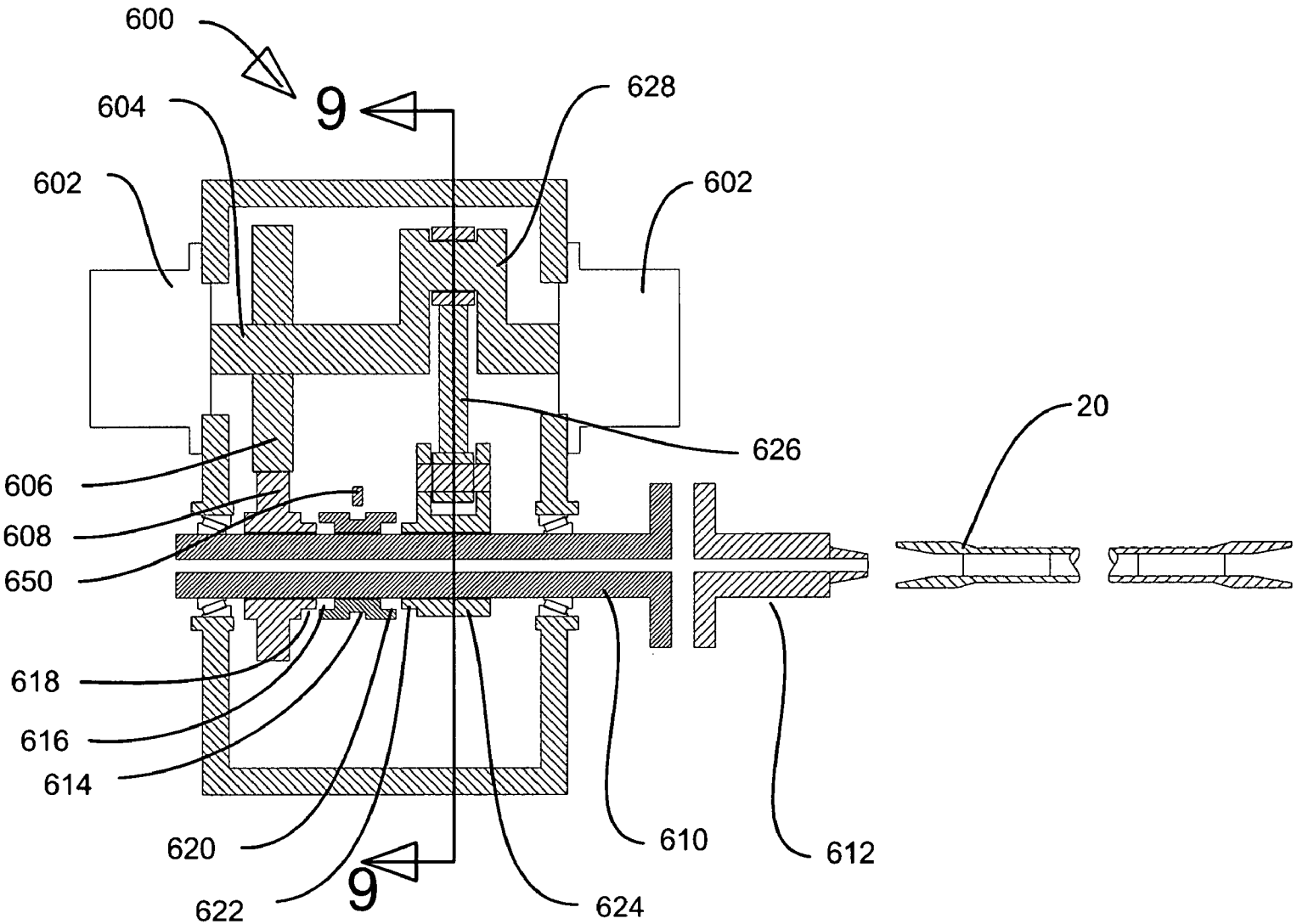
FIG. 8 is a cross-sectional schematic drawing of a gearbox illustrating another aspect of the present invention.

One embodiment of a gearbox 600 is illustrated in FIG. 8. Rotation motors 602 (schematically represented) couple to a cross-shaft 604, wherein the motors serve to support and rotationally drive the cross-shaft 604. Typically, the motors 602 and the cross-shaft 604 are coupled by a splined connection (not shown). A pinion gear 606 is mounted onto the cross-shaft 604 and mates with a drive gear 608 mounted to a drive shaft 610. The drive shaft 610 is attached to an adaptor 612 that connects to the drill string 20.

The gearbox 600, as illustrated, includes a drive arrangement that provides the two modes of drilling operation of the present disclosure. The drive shaft 610 can be driven in continuous rotation, to provide for the straight drilling mode, and can be driving in interrupted rotation, to provide for the deviated drilling mode.

Figure 10:
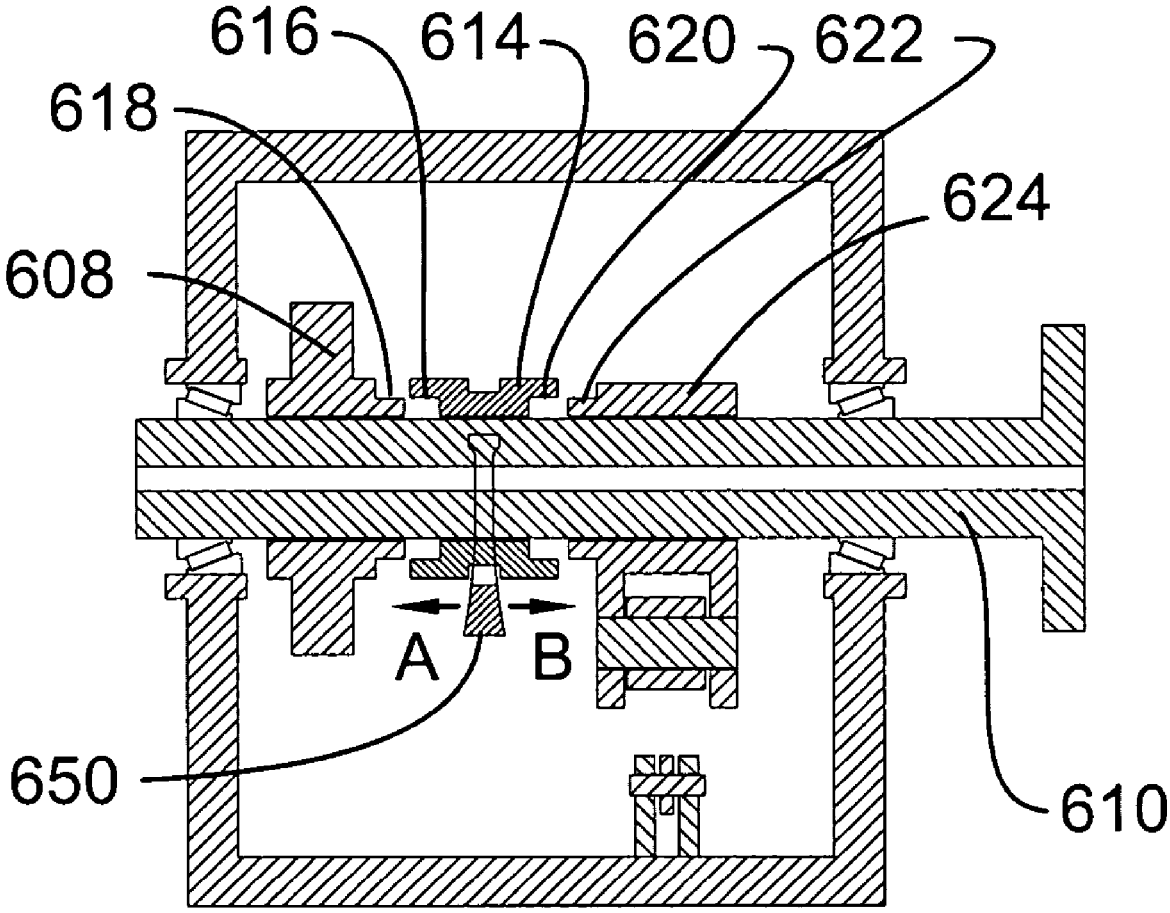
FIG. 10 is a cross-section of the gearbox taken along line 10-10 of FIG. 9.

In the straight drilling mode, a shift fork 650 shifts a coupler 614 in a direction represented by arrow A in FIG. 10 to a first position. In the first position, the coupler 614 engages the drive gear 608. In particular, a first inner coupling 616 of the coupler 614 engages with an outer coupling 618 of the drive gear 608, when the coupler 614 is moved towards the drive gear 608 by the shift fork 650. The drive gear 608 is configured to allow free-rotation on drive shaft 610, for instance with a bushing or bearing (not shown). The coupler 614 is secured to the drive shaft 610 with splines that allow the coupler 614 to be moved longitudinally, while being secured rotationally. When the coupler 614 moves so that the first inner coupling 616 is engaged with the outer coupling 618 of the drive gear 608, torque is transferred from the rotation motors 602, through the cross-shaft 604, through the pinion gear 606, the drive gear 608, the coupler 614, and to drive shaft 610. The drive shaft 610 thereby provides the continuous rotation of the drill string 20 for the straight drilling mode.

The second drilling mode of operation is provided when the shift fork 650 moves or shifts the coupler 614 in a direction represented by arrow B in FIG. 10 to a second position. In the second position, a second inner coupling 620 of the coupler 214 engages with an outer coupling 622 of a crank arm 624. When in this position, torque is transferred from the rotation motors 602, through an offset section 628 of the cross-shaft 604, translated into a force transferred through a rod 626, and applied to the crank arm 624 where it is transferred into a torque in the drive shaft 610. The drive shaft 610 will thus be oscillated, as required for the deviated drilling mode. FIGS. 9*a*-9*c* illustrate the range of travel of the drive shaft 610, alternating back and forth through an angle of approximately 120 degrees, as the cross-shaft 604 rotates continuously, when the coupler 614 is in the second position.

While the gearbox 600 of the disclosed embodiment is described in operation with a coupler 614 configured to slide, allowing selective operational engagement of either the gear 608 or the crank arm 624, it is recognized that other selective engagement techniques could be used, including but not limited to a hydraulically actuated clutch pack for both the gear 608 or the crank arm 624.

To select between the two modes of drilling operation, the operator need only select between the two positions of the coupler 614. All other operations for boring are identical. The position of the coupler 614 is controlled by the shift fork 650, shown partially in FIGS. 8 and 10.

Figure 9:
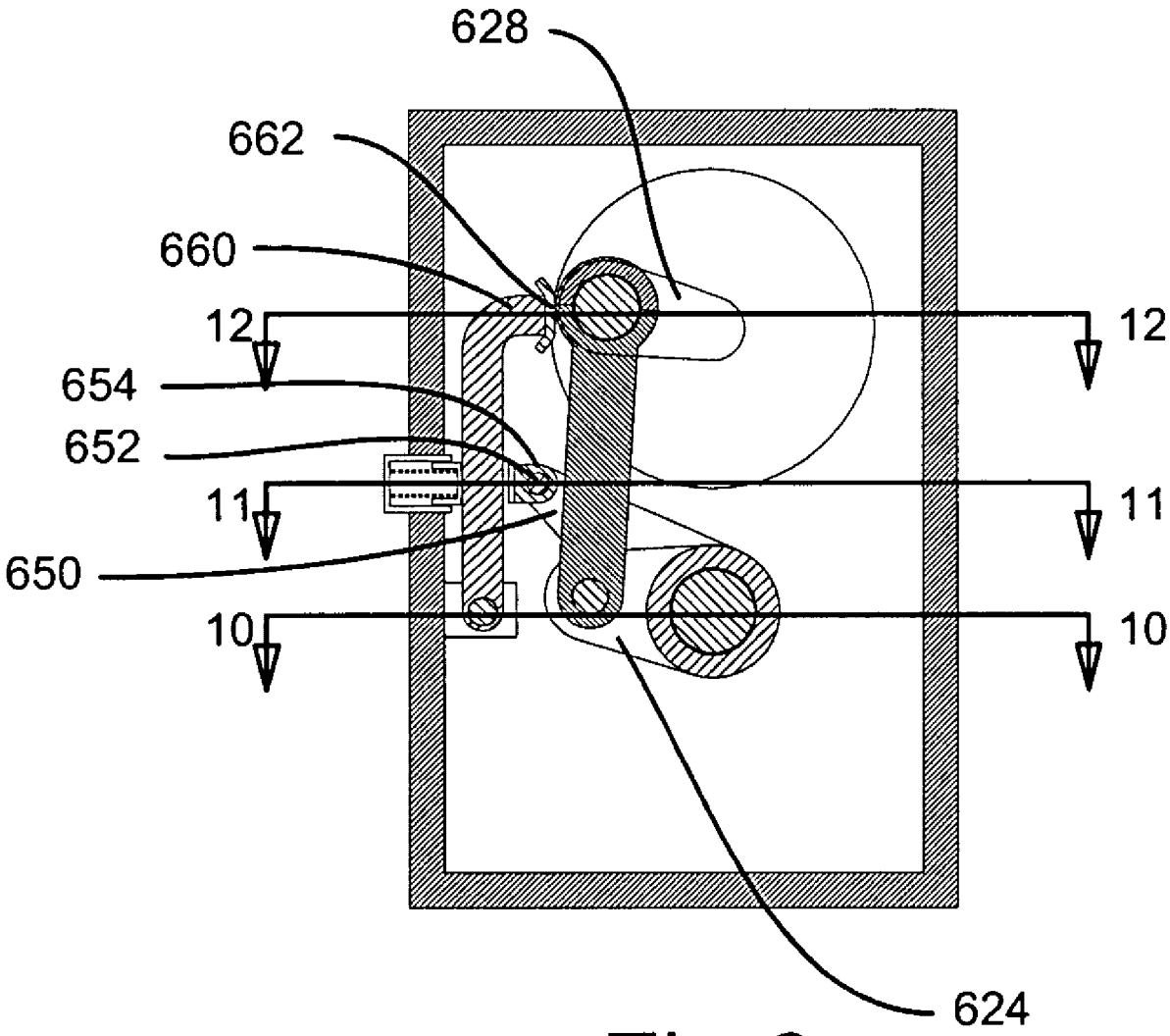
FIG. 9 is a cross-section of the gearbox taken along line 9-9 of FIG. 8.
Figure 9C:
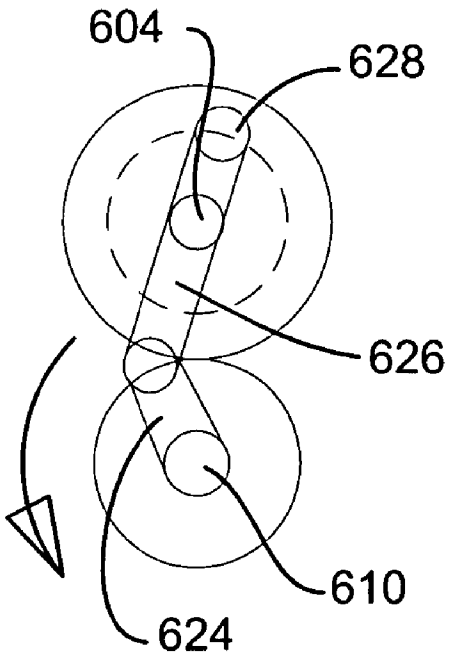
Figure 9B:
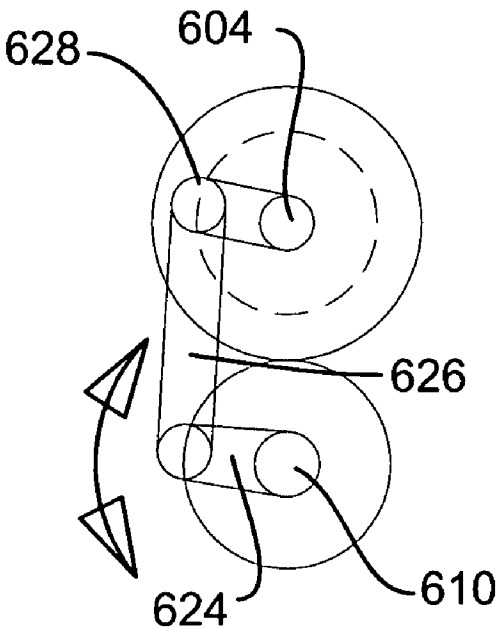
Figure 9A:
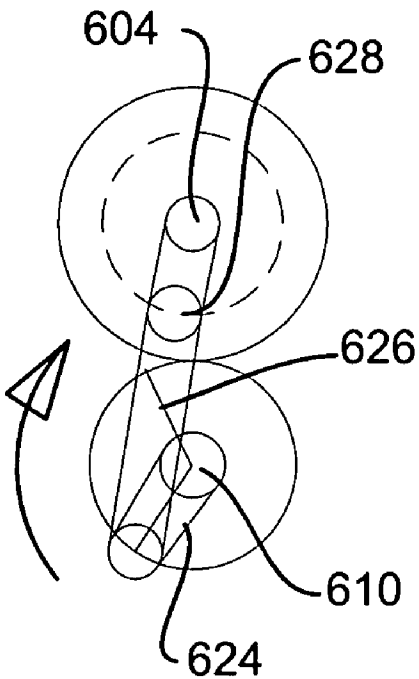

Referring now to FIG. 9, a rod 652 provides support for the shift fork 650. (In this illustration, the shift fork 650 is aligned with the coupler 614, as shown in FIG. 8). An interlock hub 654 and an interlock bar 660 cooperate to sequence the oscillating motion of the drive shaft 610. This sequencing function allows the operator to shift between the straight drilling mode and the deviated drilling mode, in a manner to reliably control the steering direction. The sequence process includes operating the gearbox 600 in a straight drilling mode, which allows the operator to rotate the drill head 100 to a selected rotational position corresponding to a desired deviation direction. Once in the selected rotational position, the drill head 100-400 is preferably oscillated about the selected rotational position, i.e., the selected rotational position becomes the center position about which the drill head is oscillated. For instance, if the deviation direction corresponds to a 3:00 direction, and a steering arc of 120 degrees, then the drill head should oscillate between a 1:00 position and a 5:00 position. In order to achieve oscillation between these positions, the coupler 614 must be shifted to engage with the crank arm 624 in only one position corresponding to the 3:00 direction.

Figure 11:
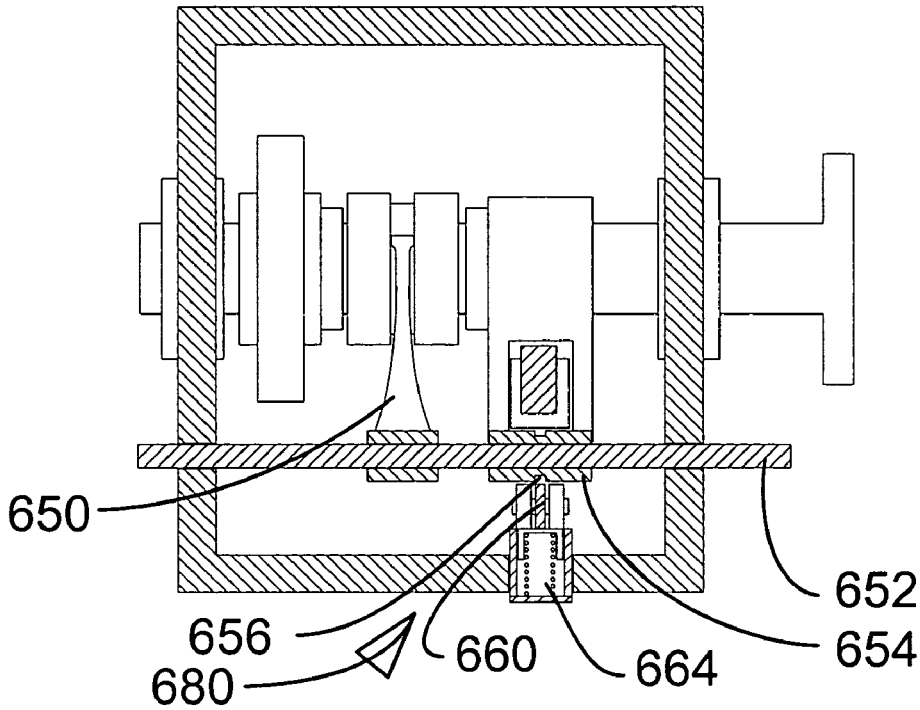
FIG. 11 is a cross-section of the gearbox taken along line 11-11 of FIG. 9; with the interlock bar in the position corresponding to the position illustrated in FIG. 9.

FIG. 11 illustrates a shifting mechanism 680 for the coupler 614. The shifting mechanism 680 include the shift fork 650 secured to the shift rod 652. One type of connection that secures the shift fork 650 and the shift rod 652 may include a key and clamped boss arrangement. The details of this type of connection are well known, and are not illustrated herein, but are defined to be a rigid connection wherein the shift fork 650 cannot move relative to the shift rod 652. The interlock hub 654 mounts to the shift rod 652 and is secured so that the hub 654 is prevented from moving longitudinally along shift rod 652. The interlock hub 654 includes a groove 656 that is wider than the thickness of interlock bar 660. A spring assembly 664 is provided to bias the interlock bar 660 towards the interlock hub 654.

Figure 11A:
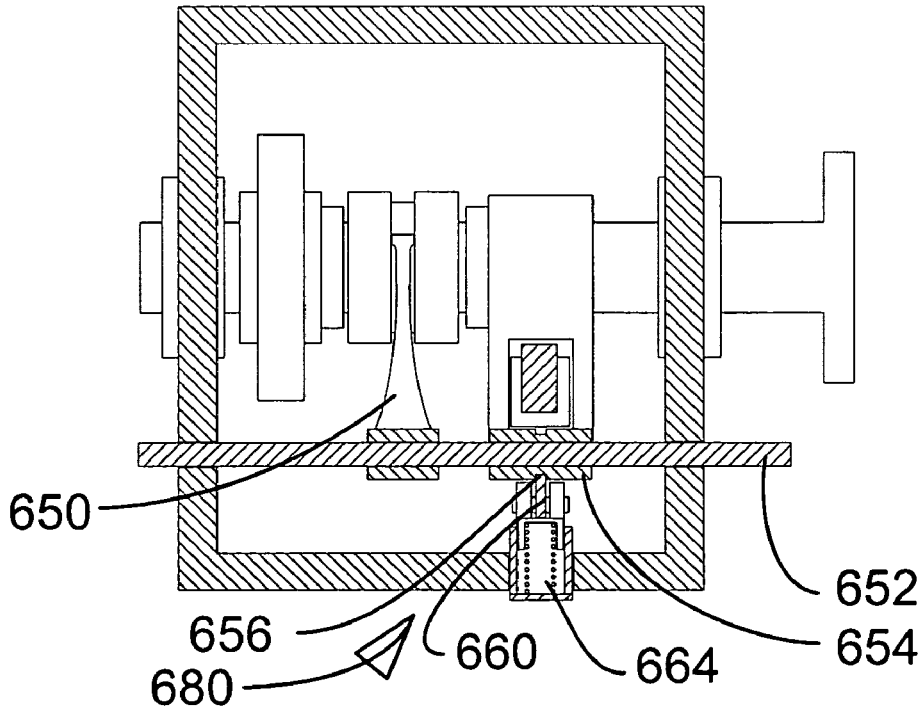

In operation, when the shift fork 650 is located in a neutral position, as illustrated in FIGS. 11 and 11*a*, the interlock bar 660 is located in one of two positions. In FIG. 11, the interlock bar 660 is not engaged with the groove 656 of interlock hub 654; and in FIG. 11*a*, the interlock bar 660 is engaged with the groove 656 of interlock hub 654. The configuration illustrated in FIG. 11 corresponds to the position of the cross-drive shaft 604 illustrated in FIG. 9 where a cam surface 662 of the interlock bar 660 is in contact with the offset section 628 of the cross-shaft 604. When the cam surface 662 is not in contact with the offset section 628, then the interlock bar 660 will be in the position illustrated in FIG. 11*a*. In the position shown in FIG. 11*a*, the shift fork 650 is locked.

Figure 12:
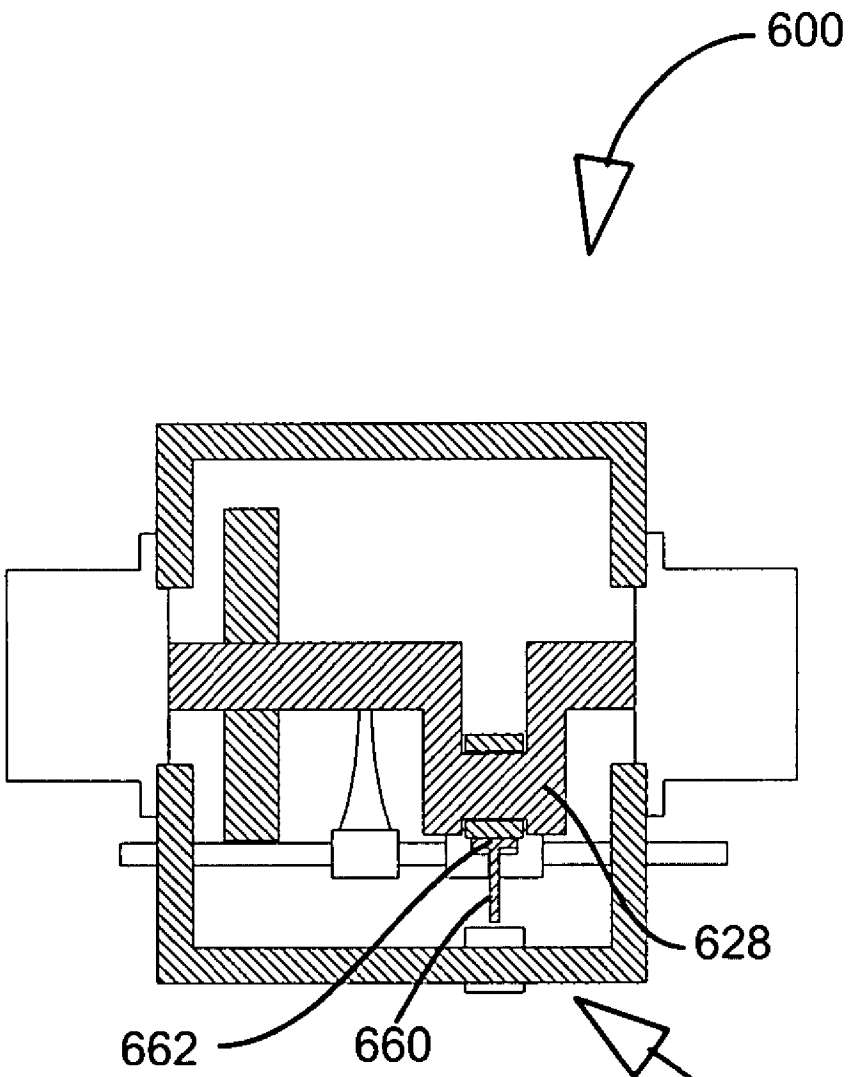
FIG. 12 is a cross-section of the gearbox taken along line 12-12 of FIG. 9.

In this manner, the position of the coupler 614 cannot move from the neutral position (FIGS. 11 and 11*a*) to either of the engaged positions corresponding to the straight or deviated drilling modes unless the cross-drive shaft 604 is at a specific position, i.e., the position illustrated in FIG. 12 where the offset section 628 of cross-drive shaft 604 is in contact with the cam surface 662 of interlock bar 660. This shifting mechanism 680 allows the operator to control the drilling operation by positioning the drill head 100-400 in a desired deviation direction while in the straight drilling mode; and with the coupler 614 in the first position, stopping the rotation of the drill head; and then shifting the coupler 614 towards the second position.

The coupler 614 will not move to the second position if the cross-shaft 604 is not located at the position illustrated in FIG. 12. Thus, the operator will then rotate the cross-shaft 604 until properly positioned (as shown illustrated in FIG. 9) such that the coupler 614 is able to shift to the second position. The shifting action could be completed via a preloaded spring, so that the actual shifting action will happen automatically. This configuration is thus capable of providing a mechanical system that is easy to operate, and that provides consistent and reliable operation.

The embodiments illustrated in FIGS. 13-16 disclose alternative mechanical drive systems including electro-hydraulic components that provide the ability to vary the oscillating motion, not possible with the purely mechanical system. One reason that this capability is desirable is that it provides an ability to adjust the oscillation pattern of an output shaft of the gearbox to compensate for the angular deflection of the drill string. Angular deflection can result from the torque required to rotate the drill bit, and can affect the rotation of the drill head and drill bit. For instance, when starting a hole, the drill string is short, and the angular deflection will be negligible; accordingly all of, or a majority of, the oscillating motion of the output shaft of the gearbox will be transferred to the drill head.

As the bored hole length increases, the length of the drill string increases, and the angular deflection (i.e. the rotational or angular lag in oscillating motion) can become significant. In particular, when the drill string 20 is a significant length, there may be an angular deflection or lag of 60 degrees, for example. In order to compensate for the lag and rotate the drill head 60 degrees from 12:00 to 2:00, the output shaft of the gearbox would need to rotate 120 degrees from 12:00 to 4:00.

In the instance of a lengthy drill string, the oscillating motion of the output shaft of the gearbox may not be transferred directly to the drill head. As the length of the drill string increases, the potential for angular deflection, or wind-up, increase. The angular deflection can be estimated using a mathematical model:

$$\theta=(TL/GJ)(180/¶)$$

where:

θ=angular deflection or angle of twist in degrees;

T=Torque;

L=Length;

G=modulus of rigidity, a property of the material of the drill string; and

J=polar area moment of inertia, a property of the shape of the drill string.

The oscillation of the output shaft of the gearbox required to provide a repeatable oscillation of the drill head will be a function of the torque required to rotate the drill bit and the length of the drill string. The oscillation pattern of the output shaft would thus preferably be controlled to compensate for the angular deflection, with the amount of rotation in the forward direction increasing to compensate for the drill string angular deflection or wind-up.

It is likely that this increased oscillating motion will be in one direction of rotation, and not the other. For instance, in the example from above, where the desired oscillation of the drill head is between 10:00 and 2:00, centered on 12:00, and there is angular deflection of 60 degrees when rotating in the first, forward direction, the output shaft of the gearbox will need to rotate from 12:00 to 4:00 in a forward direction to force the drill head to rotate from 12:00 to 2:00.

To complete the oscillation motion, the forward rotation will be followed by travel of the drill head from 2:00 to 10:00 in a reverse direction. During the reverse travel, the one-way clutch will function to allow the drill head to rotate while the drill bit remains stationary. Thus, there will be minimal torque load in the drill string, and thus minimal angular deflection of the drill string during the reverse rotation. Thus, the output shaft of the gearbox will need to move from 4:00, back to 2:00, in reverse, to unwind the drill string, before the drill head will begin to rotate backwards. The output shaft will then need to continue to rotate, further in reverse, from 2:00 and back to 10:00. During this rotation, the drill string will not be subjected to any significant torque, and angular deflection will be negligible. The drill head moves in conjunction with the output shaft of the gearbox from 10:00 back to 2:00. Thus, the output shaft of the gearbox will oscillate 180 degrees between 10:00 and 4:00, traveling through 12:00 in order to oscillate the drill head through 120 degrees between 10:00 and 2:00.

A preferred method of operation involves initiating the deviated drilling mode by oscillating the output shaft of the gearbox through the desired steering arc, in an initial oscillation pattern, while assessing information and monitoring data to allow an estimate of the amount of drill string wind-up, in order to implement an adjusted oscillation pattern. The length of the drill string is a factor that may be used in estimating drill string wind-up, as shown in the mathematical model above (the drill string wind-up is mathematically directly proportional to the length L).

Figure 13:
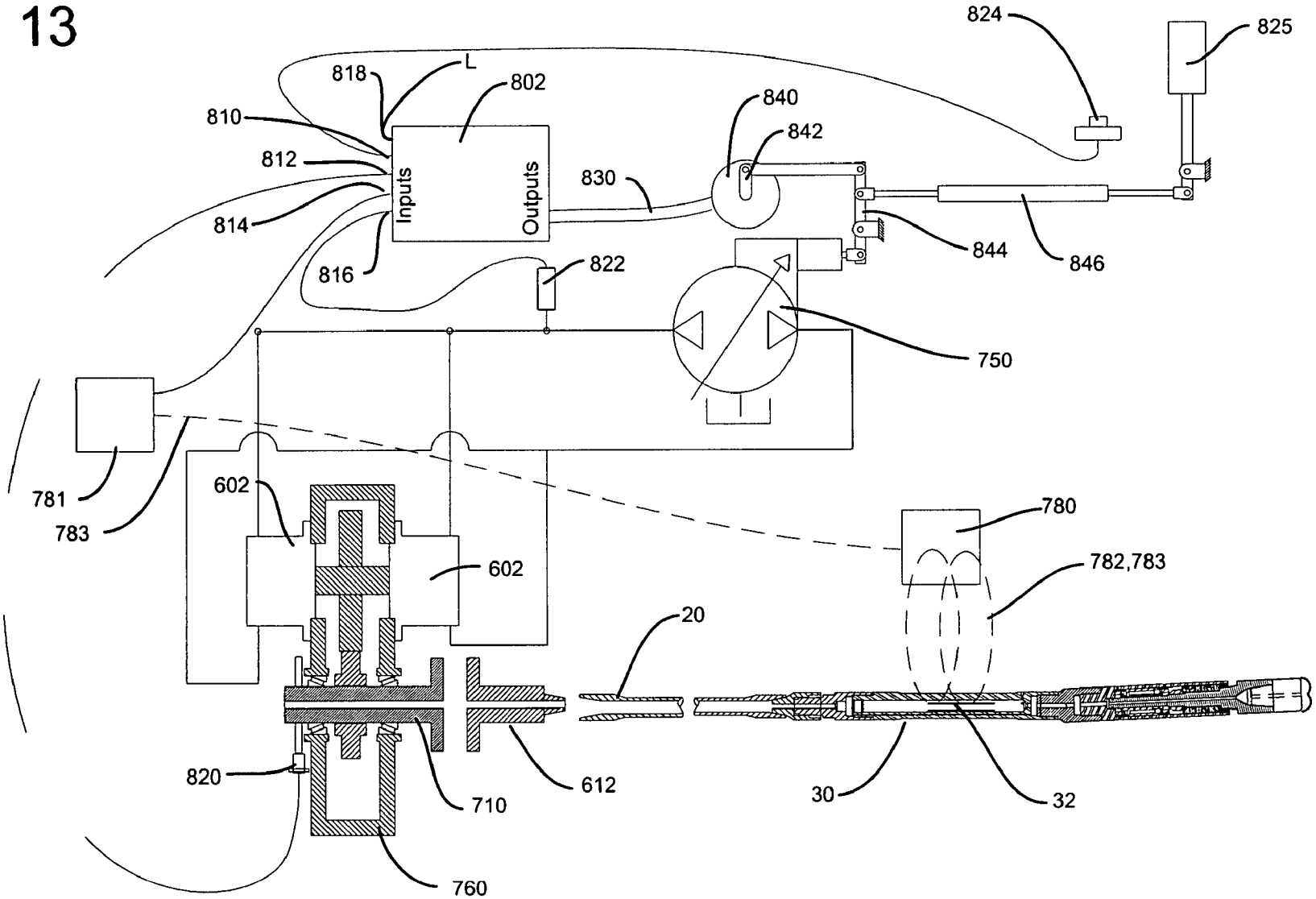
FIG. 13 is a schematic of a control system incorporating electro-mechanical components in combination with mechanical components to control a hydraulic system to incorporate oscillation of the present invention.

Referring to FIG. 13, one arrangement for operating a drilling rig 10 in accord with the principle disclosed is schematically represented. In the arrangement of FIG. 13, the length of the drill string is determined from a separate control system or controller 802 that provides a signal 818 corresponding to drill string length. One example of such a system is described in co-assigned U.S. Pat. No. 6,308,787, incorporated herein by reference. In an alternative embodiment, the signal 818 can be provided by a manual input from the operator.

In order to utilize the mathematical model, torque T necessary to rotate the drill string must also be determined. Torque T can be measured during forward rotation of the drill string, during the initial oscillation pattern. There are many possible ways to measure torque, including the use of a transducer mounted to the output shaft of the gearbox. An alternative method would be to measure the hydraulic pressure provided to the hydraulic motors 602, which will be proportional to the torque T. A pressure transducer 822 is illustrated in FIG. 13 for providing an input signal 816 corresponding to the hydraulic pressure required to rotate a drive shaft or output shaft 710 in a forward direction. Combining these two factors, T and L, allows the controller 802 to estimate drill string wind-up and compensate in order to initiate an adjusted oscillation pattern.

A second method utilizes data analysis of the torque applied to the drill string as related to the angular position, specifically looking at the torque curve during reverse rotation as a compensating factor. The relationship between torque T and rotation β of the output shaft 710 during initiation of a deviated drilling mode is illustrated in FIG. 17*a*. The initial oscillation pattern will be defined by oscillating the output shaft through the steering arc defined by +/−β1. During the initial oscillation pattern, the torque T in the drill string is a linear function of the forward rotation β of the output shaft of the gearbox until the torque required to rotate the drill head is reached.

The situation represented by the line from point 700 to point 702, illustrates a condition wherein the drill string length L and the torque T required to rotate the drill bit are sufficient to allow angular deflection θ equal to β1 (wherein the drill bit is not rotated). After the forward rotation of β1 degrees, the output shaft stops and reverses, represented by the line from 702 to 704. Wind-up of the drill string generates a residual torque that is applied to the output shaft of the gearbox. The residual torque measured at the output shaft will not be equal to zero until the output shaft is rotated back approximately β1 degrees, which in this case will position the output shaft near its original home position.

As the initial oscillation pattern continues, and the output shaft 710 of the gearbox continues to rotate in a reverse direction to −β1 (from point 706 to point 708), the rotational movement of the drill string and drill head Ø will require minimal reverse torque. If the drill head being used is identical to that illustrated in FIG. 3, the offset side 46 of the offset adaptor 40 will rotate with the drill string 20, while the drill bit 130 remains fixed due to operation of the one-way clutch 115. Thus, the rotation of the drill head Ø will be equal to −β1 degrees, rotated in the reverse direction from the center position.

As the initial oscillation pattern continues, the output shaft 710 of the gearbox is stopped and forward rotation begins at point 708. As the output shaft rotates forward from −β1 to 0, the drill string will again wind-up and the line from 708 to 710 will be parallel to the line from 700 to 702. In this case, the torque T1 is sufficient to rotate the drill head, and thus the drill head and drill string will rotate together as the output shaft rotates from 0 to +β1 degrees; resulting in drill head rotation Ø equal to β1 (wherein the drill head will be back to its initial position). Thus, if this oscillation pattern of the output shaft were to continue with the output shaft 710 rotating through +/−β1 degrees, the drill head rotation Ø will be between 0 and −β1 degrees.

It is possible to evaluate the data of the initial oscillation pattern to develop an appropriate compensation angle Ω, by determining an amount of reverse rotation corresponding to the furthest forward rotation position of the output shaft to the position of the output shaft where the residual torque in the drill string is relieved, and the torque on the drill string is zero. This is illustrated in FIG. 17*b*, where the compensation angle Ω is determined when the drill string 20 reverses from point 702 to point 704 during the initial oscillation pattern.

An adjusted oscillation pattern is illustrated in FIG. 17*c*. The forward rotation begins at point 708, wherein the drill head has been rotated −Ø degrees. The drill string will wind-up and the drill head will not rotate until sufficient torque is generated at point 710. The output shaft 710 of the gearbox will continue to rotate in a forward direction to point 712, identical to the initial oscillation pattern, which will result in drill head rotation of +Ø back to its initial position, and will continue with a compensation, rotating to β2, wherein β2=β1+Ω1.

The drill head will then rotate an additional +Ø degrees. As this oscillation pattern continues, the output shaft will rotate through +β2 to −β1, which will result in the drill head rotation through +/−Ø degrees.

A number of initial oscillation cycles, equivalent to that illustrated in FIG. 17*a*, may be necessary to verify the accuracy of the compensation angle Ω. The controller will modify the oscillation pattern of the output shaft of the gearbox to initiate the adjusted oscillation pattern, and will continue to monitor the accuracy of the compensation angle Ω.

FIGS. 18 (*a*) through (*d*) illustrate an example where the compensation angle will become more accurate as compensation is implemented. FIG. 18 (*a*) illustrates an example where the drill string is more flexible than the drill string illustrated in FIG. 17(*a*). In the example of FIG. 18 (*a*) the initial oscillation pattern would start at point 800 wherein the output shaft would rotate to +β1 generating a first amount of torque at point 802. The output shaft would then reverse and rotate to −β1 wherein the torque will first drop to zero at point 804, and will then drop to a minimal reverse torque as the drill string and offset adaptor rotate in reverse with the drill string to point 806. As the initial oscillation pattern continues, the output shaft 710 of the gearbox is stopped and forward rotation begins at point 806. As the output shaft rotates forward from −β1 to 0, the drill string will again wind-up and the line from 806 to 808 will be parallel to the line from 800 to 802. The initial oscillation pattern will continue with rotation of the output shaft from +/−β3 degrees. In this case the drill head would never rotate, and the progress of the drilling would stop.

FIG. 18*b* illustrates an initial single cycle of an initial oscillation pattern wherein a first compensation angle Ω1 is determined. FIG. 18*c* illustrates the next subsequent oscillation cycle wherein the output shaft is rotated to β2=β1+Ω1. In this example, the first compensation angle is not sufficient, and the subsequent compensation angle Ω2 is measured during this cycle. Since Ω2 is greater than Ω1, the next subsequent oscillation pattern, illustrated as FIG. 18*d*, utilizes the latest compensation angle and β3=β1+Ω2. This method can include a technique of dynamically modifying the compensation angle to allow the system to automatically adjust for variations in the wind-up of the drill string that can be caused by variations in the length of the drill string and the torque required to rotate the drill bit.

A third alternative method would be to monitor a clock position signal 814, as illustrated in FIG. 13, to adjust the oscillation pattern. The clock position signal 814 could be generated using one of a number of systems; for example, from raw data will be generated by the sonde or transmitter 32 located in the sonde housing 30 of the drill head 100-400. The sonde 32 includes an electronic device that measures the clock position or rotational orientation, and generates raw clock position data. The sonde further includes data processing capability to manipulate the raw clock position data to generate data in a number of different configurations.

A first, common, configuration of data is generated by an arrangement including a wireless communication link 782 and a receiver 780 located above ground. In this arrangement, the sonde 32 converts the raw clock position data into a digital signal superimposed on an electromagnetic signal 792 that is transmitted to the above ground receiver 780. The above ground receiver then transmits an associated signal 783 to a remote unit 781 mounted on the drilling rig 10, The associated signal 783 includes filtered clock position data. The filtered clock position data is a representation of the raw clock position data. The data manipulation at the sonde 32, necessary to transmit the signal using the wireless transmission links 782, is effectively a type of filter.

In a second configuration the wireless communication links 782 and 783 are replaced with a wireline, wherein there is a physical communication link passing through the drill string 20 between the sonde 32 and the remote unit 781 located on the drilling rig 10. This configuration will allow transmission of a different signal; the raw clock position data will not need to be filtered to the same level as with the wireless communication of the first configuration, because the wireline has capacity to transmit data at a higher rate of transmission, thus requiring less filtering.

In either case, the remote unit 781 is capable of generating the clock position signal 814 that is an indication of the measured oscillation of the drill head 100-400. In the first configuration, the signal 782 is transmitted at a frequency, which the wireless communication links 782 and 783 are capable of supporting. This frequency may be less than the frequency of the actual oscillations of the drill head, when the drill head is oscillating at a full speed. Thus, as the drill head begins to oscillate, the compensation for drill string wind-up may lag by a significant time, 1 to 5 seconds.

In particular, the controller 802 will initiate the desired oscillation upon receiving a signal 810 from a switch 824. The switch 824 is typically located at the operator station, and is manually actuated by the operator when deviated drilling is desired. The signal 810 includes an initial oscillation pattern of the output shaft 710. The initial oscillation pattern will be controlled via a feedback signal 812 from a rotation sensor 820, in order to oscillate the shaft 710 and drill string 20, through the desired angle. If there is no drill string wind-up, the drill head will be rotated through the same oscillation. As the shaft 710 is oscillated with this initial oscillation pattern, the clock position signal 814 will be monitored to determine whether the oscillation at the shaft 710 is transferred through the drill string 20. After an initial period of operation, the oscillation of the shaft 710 will be modified to an adjusted oscillation pattern, as necessary to transmit the desired oscillation to the sonde 32 at the drill head 100-400. The initial oscillation pattern may be at a lower frequency, allowing determination of an appropriate adjustment, while the adjusted oscillation pattern may be at a higher frequency.

An alternative system may include data manipulation at the sonde 32, wherein the raw clock position data could be monitored, and the sonde could produce a signal to communicate the range of oscillation of the drill head. This system would also require some lag time between an initial oscillation pattern, and an adjusted oscillation pattern, as it will take some time for the sonde to recognize the oscillations, in order to detect that a deviated mode of boring has been initiated, and to monitor several oscillations in order to produce the range of oscillation signal.

Figure 14:
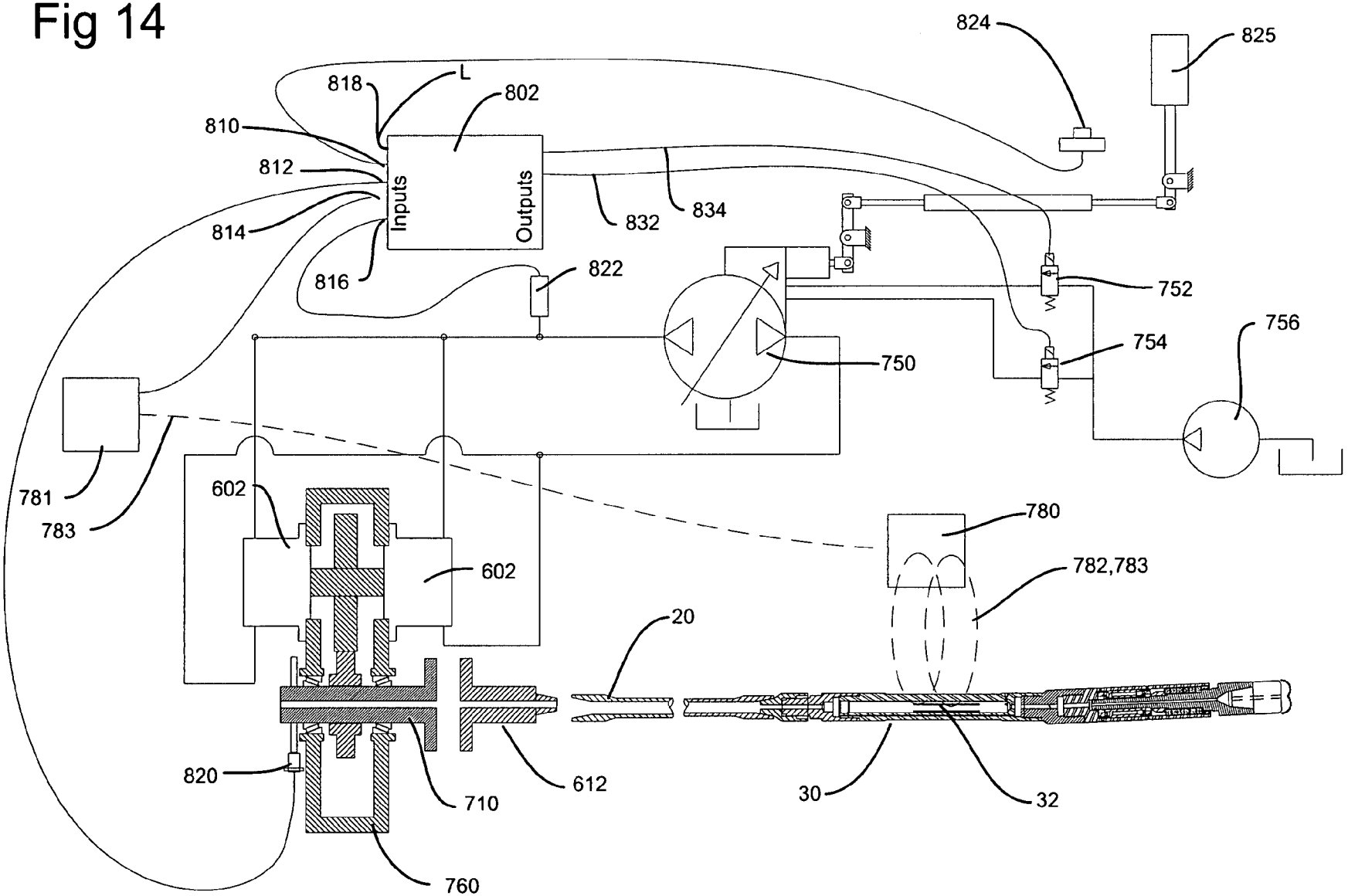
FIG. 14 is a schematic of an alternative control system incorporating electro-hydraulic components in combination with mechanical components to control a hydraulic system to incorporate oscillation of the present invention.

FIGS. 13 and 14 illustrate alternative systems that would provide variable oscillation for deviated drilling. In these Figures, a hydraulic pump 750 provides hydraulic power to the hydraulic motors 602 mounted to a gearbox 760, in a manner that the speed and direction of rotation of the output shaft 710 is controlled by a first control lever 825 that activates a cable 846 that positions a second control lever 844. In both arrangement of FIGS. 13 and 14, the controller 802 receives the feedback signal 812 from the rotation sensor 820. The feedback signal 812 from the rotation sensor 820 represents the direction and amount of rotation of the output shaft 710.

To initiate deviated drilling in the arrangements of FIGS. 13 and 14, the operator first releases the manual control lever 825, which is used to control rotation during straight drilling, after the drill head is positioned in the desired steering direction. The operator then activates the deviated drilling switch 824. The signal 810 will indicate to the controller 802 that the deviated drilling mode should be initiated.

The controller 802 operates to provide control signals necessary to oscillate the output shaft 710 in a manner to attempt to cause the drill head to oscillate about the rotational position corresponding to its position at time the deviated drilling switch 824 is initially depressed. In FIG. 13, operation is controlled by providing an electrical signal 830 to energize an electrical motor 840 that powers an eccentric 842. The eccentric 842 generates mechanical movement of the second control lever 844. The second control lever 844 provides a mechanical signal to the hydraulic pump 750, which is also activated by cable 846 and control lever 825 during straight drilling.

The controller 802 energizes the electric motor 840 in a first direction, to cause the output shaft 710 to rotate in the first, forward direction. During this rotation, the controller 802 will monitor the rotation of the output shaft 710 via the feedback signal 812. When the desired amount of rotation has been achieved, the controller 802 will modify the electrical signal 830 and cause the electric motor 840 to rotate in the opposite direction. This will in turn cause the eccentric 842 to move the control lever 844 into the opposite position, whereby the hydraulic pump 750 will reverse the direction of rotation of the output shaft 710. The controller 802 will continue to monitor the feedback signal 812 to control the amount of reverse rotation of the output shaft 710. In this manner, the controller 802 is able to control the oscillation of the output shaft of the gearbox, in a variable manner.

Based on any combination of the previously described inputs, the controller 802 is capable of modifying the electric signal 830 to control the electric motor 840 to achieve the desired oscillation of the drill head during deviated drilling, by implementation of the adjusted oscillation pattern. FIG. 14 illustrates an alternative method of controlling the hydraulic system. Rather than utilizing the electrical motor 840 to mechanically manipulate the control lever 844 of the previous arrangement, this arrangement utilizes two control signals 832 and 834 to control poppet valves 752 and 754. When energized, the poppet valves direct hydraulic pressure from a secondary pump 756 to the main hydraulic pump 750 where the pressure hydraulically activates an internal servo circuit of the pump 750 causing the pump 750 to generate rotation of the output shaft in a desired direction, independent of a mechanical control system, such as the motor 840, eccentric 842 and lever 844 of FIG. 13. The other aspects of operation are identical to that described earlier for FIG. 13.

Figure 15:
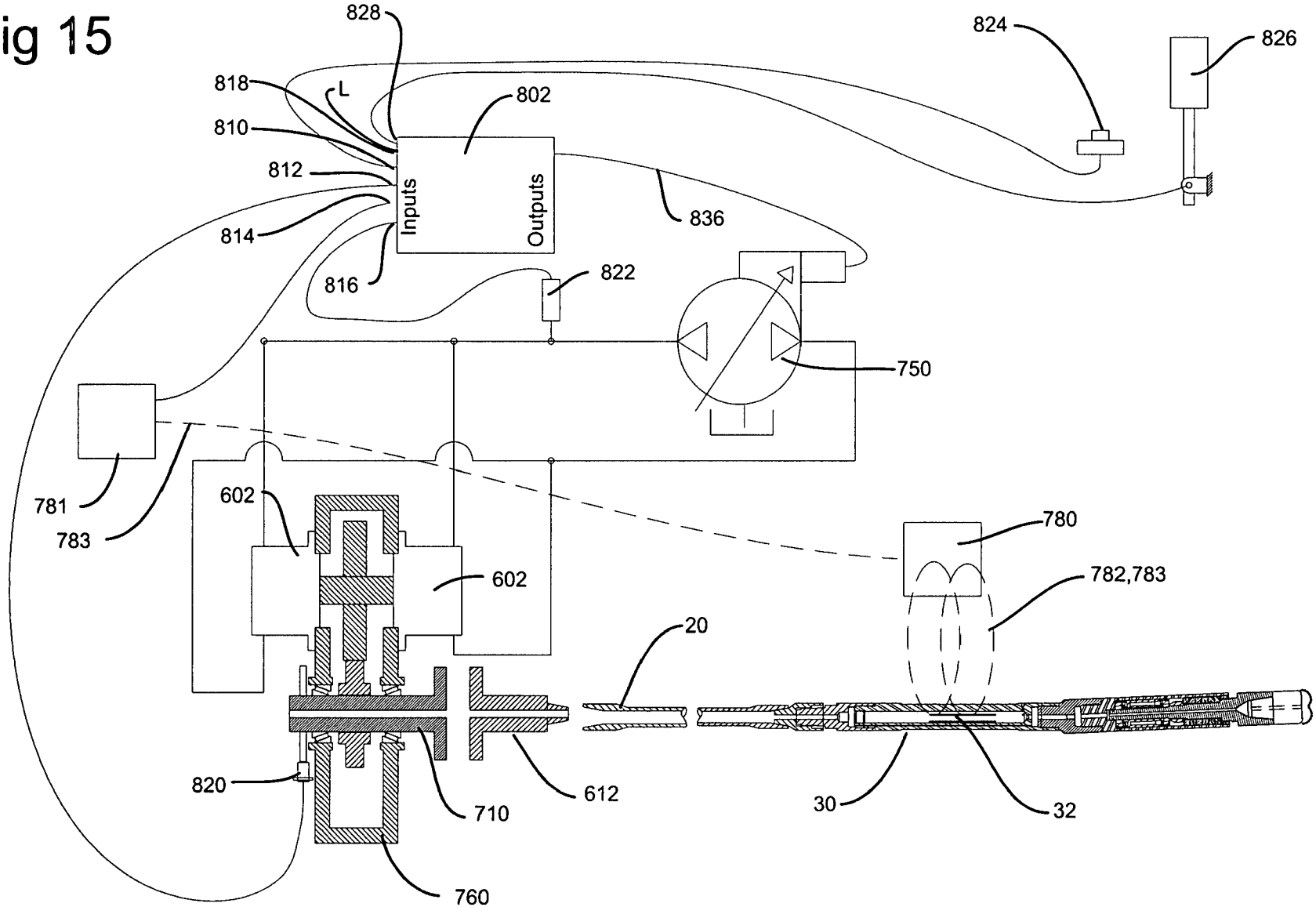
FIG. 15 is a schematic of an alternative control system incorporating electro-hydraulic components to control a hydraulic system to incorporate oscillation of the present invention.

FIG. 15 illustrates yet another alternative embodiment of a hydraulic system wherein the hydraulic pump 750 is controlled by an electric signal 836. In this embodiment, a control lever 826 generates a signal 828 that is an input to the controller 802. In this configuration, the controller 802 provides the electric signal 836 to the hydraulic pump 750 to control the flow direction and flow rate in both drilling modes, i.e., the straight drilling mode and deviated drilling mode. All other functions, involving the initiation and control of oscillation are similar to that previously described with respect to FIG. 13.

Figure 16:
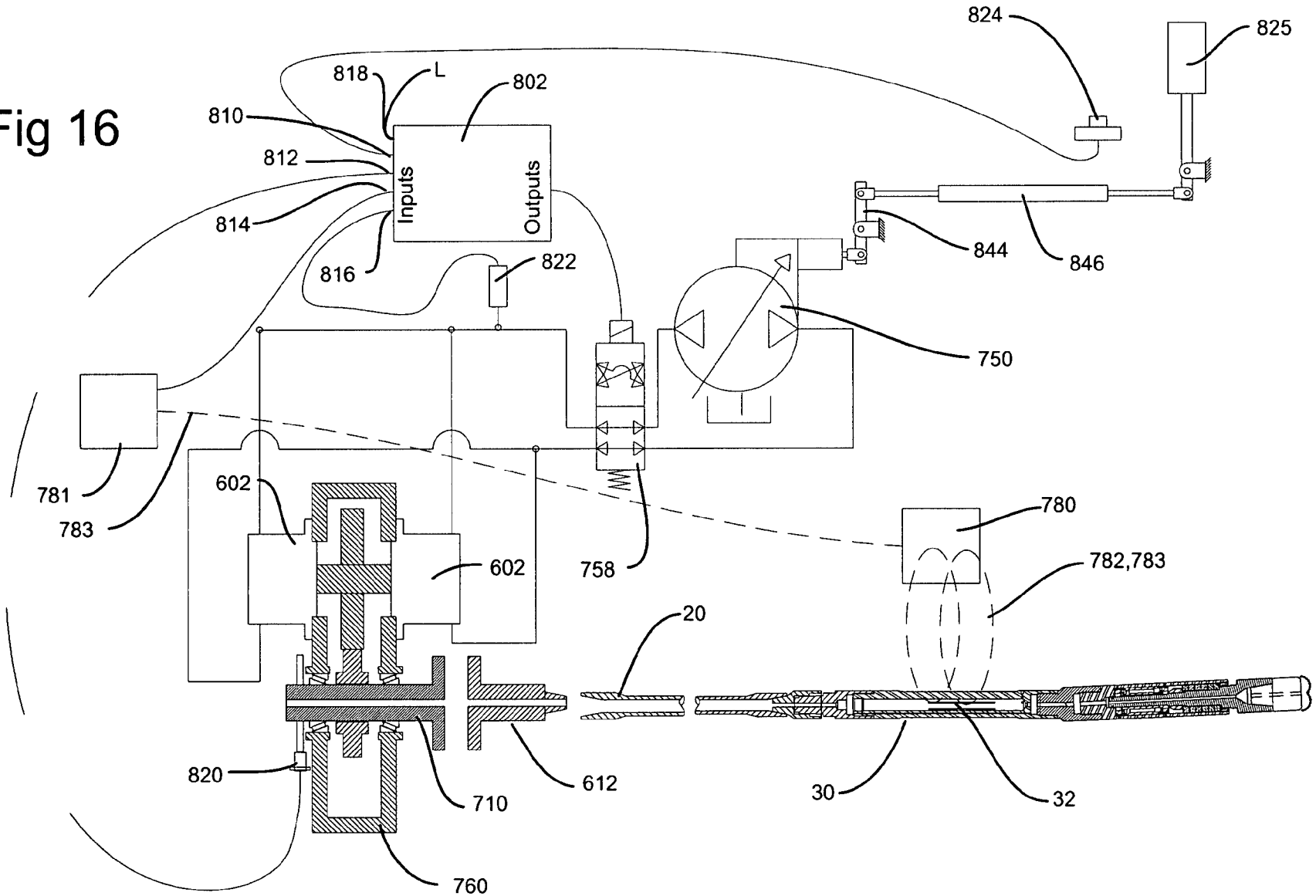
FIG. 16 is a schematic of an alternative control system incorporating electro-hydraulic components to control a hydraulic system to incorporate oscillation of the present invention, while the mechanical control linkage is not affected.

FIG. 16 illustrates an additional alternative embodiment wherein the hydraulic pump 750 is controlled exclusively by the first control lever 825 and the cable 826. The first control lever 825 can include, for example, a mechanical joystick. To initiate oscillation, the operator rotates the drill string 20 to a desired position in which to initiate a steering correction. Activation of the switch 824 indicates to the controller 802 that the position, as measured by the rotation sensor and the feedback signal 812 is the desired steering position. The initial oscillation pattern will be initiated by leaving a valve 758 in a de-energized position until shaft 710 has rotated through the desired angle of rotation. When the output shaft 710 reaches the desired angle of rotation, the valve 758 shifts to an energized position (via a solenoid, not shown) to reverse the flow of hydraulic fluid, and reverse the direction of rotation of the output shaft 710. It will be held in this position until the output shaft rotates through the necessary angle of rotation in the opposite direction where the valve 758 will shift to the de-energized position. In the de-energized position, the valve returns to its initial position and flow and rotation reversed.

The sequence of energizing and de-energizing the solenoid of the valve 758 produces the oscillation pattern. The actual speed of rotation of the output shaft 710 and drill string 20 will be controlled by the mechanical position of the joystick 825. Thus, the operator will have direct control of the speed of rotation, while the electrical system will have control of the direction of rotation as necessary to produce an initial oscillation pattern followed by an adjusted oscillation pattern as previously described.

The embodiments of the present disclosure may be used in applications other than horizontal boring. For example, in many vertical drilling applications, directional drilling techniques are used. The details disclosed in the above teachings are recognized to be applicable to such vertical drilling applications.

In addition, many other modifications and variations of the present invention are possible in light of the above teachings. It is therefore to be understood that, within the scope of the appended claims, the invention may be practiced otherwise than as specifically described.

What is claimed is:

1. A drilling arrangement for drilling a borehole in the earth, the arrangement comprising:

a) a drill string defining a first axis of rotation; and b) a boring head attached to an end of the drill string, the boring head including:

i) a transmitter for measuring the relative position of the boring head to the drill string;

ii) an offset coupling interconnected to the transmitter, wherein the offset coupling includes a first end having an axis of rotation that is aligned with the first axis of rotation and a second end configured to define a second axis of rotation that is offset from the first axis of rotation at a predetermined angle;

iii) a bit drive element having an axis of rotation that is aligned with the second axis of rotation, the bit drive element including a one-way clutch; and iv) a drill bit interconnected to the bit drive element;

wherein the one-way clutch is located between the bit and the offset coupling.

2. The arrangement of claim 1, wherein the offset coupling is directly coupled to the transmitter.

3. The arrangement of claim 1, wherein the offset coupling is located between the transmitter and the bit drive element.

4. The arrangement of claim 3, further including a hammer located between the transmitter housing and the offset coupling.

5. The arrangement of claim 3, further including a hammer located between the offset coupling and the bit drive element.

6. The arrangement of claim 1, wherein the transmitter housing is located between the offset coupling and the bit drive element.

7. The arrangement of claim 1, wherein the one-way clutch is configured to transfer rotational torque to the drill bit in a first direction, and to freely rotate without transfer of rotational torque in a second opposite direction.

8. The arrangement of claim 1, wherein the bit drive element further includes thrust bearings and a drive shaft, the one-way clutch being sized to mount to the drive shaft.

9. The arrangement of claim 1, wherein the offset coupling is configured such that the orientation of the first axis of rotation relative to the second axis of rotation can be adjusted.

10. A drilling arrangement for drilling a borehole in the earth, the arrangement comprising:

a) a drill string defining a first axis of rotation: and b) a boring head attached to an end of the drill string, the boring head including:

i) a transmitter for measuring the relative position of the boring head to the drill string:

ii) an offset coupling interconnected to the transmitter, wherein the offset coupling includes a first end having an axis of rotation that is aligned with the first axis of rotation and a second end configured to define a second axis of rotation that is offset from the first axis of rotation at a predetermined angle;

iii) a bit drive element having an axis of rotation that is aligned with the second axis of rotation, the bit drive element including a one-way clutch; and iv) a drill bit interconnected to the bit drive element:

wherein the first end of the offset coupling is adapted to interconnect concentrically with the first axis of rotation of the drill string, the second end of the offset coupling is adapted to define the offset axis of rotation about which the bit drive element rotates.

11. A boring head attachable to a drill string for drilling a borehole in the earth, the boring head comprising:

a) a bit drive element including:

i) a first bit drive component defining an interior bore, the first bit drive component being configured to be rotated by a drill string;

ii) a second bit drive component having a drive shaft, the second bit drive component being configured to be rotated by the first bit drive component; and iii) a clutch disposed around a portion of the drive shaft of the second bit drive component, wherein a portion of the clutch and a portion of the drive shaft of the second bit drive component are positioned within the interior bore of the first bit drive component, wherein the clutch is arranged to permit the first bit drive component to rotate independently of the second bit drive component;

b) a drill bit coupled to the second bit drive component;

c) an offset coupling having a first end and a second end, the first end defining a first axis of rotation and the second end defining a second axis of rotation, the second axis of rotation being offset from the first axis of rotation;

wherein the clutch is located between the drill bit and the offset coupling.

12. The boring head of claim 11, further including a transmitter housing coupled to the first end of the offset coupling.

13. The boring head of claim 12, further including a hammer located between the transmitter housing and the bit drive element.

14. The boring head of claim 11, further including a transmitter housing coupled to the second end of the offset coupling.

15. The boring head of claim 11, wherein the drill bit is a symmetrical bit.

16. A method of using a boring head attached to a drill string for drilling a borehole in the earth, the method comprising the steps of:

a) mounting the boring head to a drill string, the boring head including a bit drive element interconnected to a drill bit;

b) rotating the drill string and the bit drive element and the drill bit of the boring head in a first direction;

c) rotating the drill string and the bit drive element of the boring head in a second opposite direction, the drill bit remaining stationary during rotation of the bit drive element in the second direction;

wherein rotating the drill string in the first direction maintains a drill direction whereas rotating the drill string in the two directions sequentially alters the drill direction.

17. The method of claim 16, further comprising the step of operating the drill string in a first drilling mode to produce straight advancement of the boring head, the operating the drill string in the first drilling mode including continuously rotating the boring head in the first direction.

18. The method of claim 17, further comprising the step of operating the drill string in a second drilling mode to produce a boring head steering arc, operating the drill string in the second drilling mode including oscillating the drill string in the first and second directions.

19. The method of claim 16, wherein the step of mounting the boring head to the drill string, including mounting the boring head to the drill string, the boring head including a bit drive element having a one-way clutch.

20. The method of claim 19, wherein the step of rotating the drill string and the bit drive element of the boring head in the second opposite direction includes freely rotating the one-way clutch in the second direction without transferring rotational torque to the drill bit.

* * * * *